US007885581B2

(12) United States Patent
Oshige et al.

(10) Patent No.: US 7,885,581 B2
(45) Date of Patent: Feb. 8, 2011

(54) DEVELOPER TRANSFERRING DEVICE, DEVELOPING DEVICE, PROCESS UNIT, AND IMAGE FORMING APPARATUS

(75) Inventors: Wakako Oshige, Tokyo (JP); Shinji Kato, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 452 days.

(21) Appl. No.: 11/856,304

(22) Filed: Sep. 17, 2007

(65) Prior Publication Data

US 2008/0069580 A1 Mar. 20, 2008

(30) Foreign Application Priority Data

Sep. 19, 2006 (JP) ..... 2006-253292
Jul. 31, 2007 (JP) ..... 2007-199687

(51) Int. Cl.
*G03G 15/08* (2006.01)
*B01F 7/00* (2006.01)

(52) U.S. Cl. ..... 399/256; 366/319; 399/62

(58) Field of Classification Search ..... 399/62, 399/64, 256, 254; 366/319, 81, 309, 310, 366/312

See application file for complete search history.

(56) References Cited

U.S. PATENT DOCUMENTS 2,645,911 A * 7/1953 Martin ..... 366/309
4,723,143 A * 2/1988 Enomoto ..... 399/254
4,963,033 A * 10/1990 Huber et al. ..... 366/319
5,231,452 A 7/1993 Murayama et al.
5,327,196 A 7/1994 Kato et al.
5,387,965 A 2/1995 Hasegawa et al.
5,475,476 A 12/1995 Murai et al.
5,493,382 A 2/1996 Takagaki et al.
5,671,470 A 9/1997 Maruta et al.
5,722,002 A * 2/1998 Kikuta et al. ..... 399/256
5,765,059 A 6/1998 Kosuge et al.
5,860,038 A 1/1999 Kato et al.
5,970,276 A 10/1999 Kato (Continued)

FOREIGN PATENT DOCUMENTS

JP 63-49569 4/1988

(Continued)

OTHER PUBLICATIONS

U.S. Appl. No. 12/112,525, filed Apr. 30, 2008, Koizumi, et al.

(Continued)

*Primary Examiner*—Susan S Lee
(74) *Attorney, Agent, or Firm*—Oblon, Spivak, McClelland, Maier & Neustadt, L.L.P.

(57) ABSTRACT

An image forming apparatus capable of reducing the number of toner concentration detection errors caused by variation in the volume of a toner includes a reverse vane for transferring developer in an opposite direction and protruding from the rotary shaft member in a region where a lower side faces a bottom wall of a first transfer chamber and two lateral sides that are orthogonal to the rotary axis direction face respective side walls of the first transfer chamber, and a toner concentration detection sensor is disposed to detect the toner concentration of the developer as the developer is transferred between the reverse transfer vane and a location of the screw vane adjacent to the reverse transfer vane.

11 Claims, 30 Drawing Sheets

U.S. PATENT DOCUMENTS

| | | | | |
|---|---|---|---|---|
| 6,081,678 | A | 6/2000 | Kato | |
| 6,195,519 | B1 | 2/2001 | Isobe et al. | |
| 6,526,235 | B2 | 2/2003 | Kato | |
| 6,594,453 | B2 | 7/2003 | Kato | |
| 6,597,881 | B2 | 7/2003 | Hatori et al. | |
| 6,798,996 | B2 | 9/2004 | Sawada et al. | |
| 7,003,238 | B2 | 2/2006 | Yoshida et al. | |
| 7,024,133 | B2 | 4/2006 | Nagashima et al. | |
| 7,136,610 | B2 | 11/2006 | Arai et al. | |
| 7,190,912 | B2 | 3/2007 | Kato | |
| 7,203,433 | B2 | 4/2007 | Kato et al. | |
| 7,228,081 | B2 | 6/2007 | Hasegawa et al. | |
| 7,251,420 | B2 | 7/2007 | Fujimori et al. | |
| 7,260,335 | B2 | 8/2007 | Kato et al. | |
| 2002/0159781 | A1* | 10/2002 | Hatori | 399/62 |
| 2005/0013636 | A1 | 1/2005 | Sawai et al. | |
| 2005/0238384 | A1 | 10/2005 | Sampe et al. | |
| 2006/0008296 | A1 | 1/2006 | Sampe et al. | |
| 2006/0018680 | A1 | 1/2006 | Hosokawa et al. | |
| 2006/0062612 | A1 | 3/2006 | Kimura et al. | |
| 2006/0115292 | A1 | 6/2006 | Sampe et al. | |
| 2006/0120741 | A1 | 6/2006 | Murakami et al. | |
| 2006/0274628 | A1 | 12/2006 | Tanaka et al. | |
| 2007/0019976 | A1 | 1/2007 | Watanabe et al. | |
| 2007/0025748 | A1 | 2/2007 | Ishibashi et al. | |
| 2007/0036566 | A1 | 2/2007 | Takeuchi et al. | |
| 2007/0065164 | A1 | 3/2007 | Fujimori et al. | |
| 2007/0104499 | A1 | 5/2007 | Ariizumi et al. | |
| 2007/0110457 | A1 | 5/2007 | Kato et al. | |
| 2007/0116480 | A1 | 5/2007 | Takeuchi et al. | |
| 2007/0122168 | A1 | 5/2007 | Tanaka et al. | |
| 2007/0122169 | A1 | 5/2007 | Shimizu et al. | |
| 2007/0122171 | A1 | 5/2007 | Fujimori et al. | |
| 2007/0134014 | A1 | 6/2007 | Kato et al. | |
| 2007/0196116 | A1 | 8/2007 | Watanabe | |
| 2007/0223944 | A1* | 9/2007 | Mizuta | 399/254 |

FOREIGN PATENT DOCUMENTS

| | | |
|---|---|---|
| JP | 64-38778 | 2/1989 |
| JP | 4-52672 | 2/1992 |
| JP | 5-341649 | 12/1993 |
| JP | 6-19316 | 1/1994 |
| JP | 6-308833 | 11/1994 |
| JP | 7-271175 | 10/1995 |
| JP | 11-202610 | 7/1999 |
| JP | 2003-215903 | 7/2003 |
| JP | 2003-255707 | 9/2003 |
| JP | 2003-307918 | 10/2003 |
| JP | 2005-91774 | 4/2005 |
| JP | 2005-91804 | 4/2005 |

OTHER PUBLICATIONS

U.S. Appl. No. 07/811,056, filed Dec. 20, 1991, Yuko Harasawa, et al.
U.S. Appl. No. 07/873,154, filed Apr. 24, 1992, Mitsuhisa Kanaya, et al.

* cited by examiner

FIG. 10

| NO. | Vmax | $V_D$ | $V_B$ | $V_L$ |
|---|---|---|---|---|
| 1 | 160 | 400 | 260 | 110 |
| 2 | 180 | 429 | 286 | 118 |
| 3 | 200 | 457 | 311 | 126 |
| 4 | 220 | 486 | 337 | 133 |
| 5 | 240 | 514 | 363 | 141 |
| ⋮ | ⋮ | ⋮ | ⋮ | ⋮ |
| 16 | 460 | 829 | 646 | 226 |
| 17 | 480 | 857 | 671 | 234 |
| 18 | 500 | 886 | 697 | 241 |
| 19 | 520 | 914 | 723 | 249 |
| 20 | 540 | 943 | 749 | 257 |

DEVELOPER TRANSFERRING DEVICE, DEVELOPING DEVICE, PROCESS UNIT, AND IMAGE FORMING APPARATUS

BACKGROUND OF THE INVENTION

1. Field of the Invention

The present invention relates to a developer transferring device comprising an agitating transfer member for transferring a developer containing a toner and a magnetic carrier in an axial direction while agitating the developer as it rotates, and toner concentration detecting means for detecting the toner concentration of the developer that is transferred by the agitating transfer member. The present invention also relates to a developing device, a process unit, and an image forming apparatus using the developer transferring device.

2. Description of the Related Art

Conventionally, this type of developing device carries a developer transferred by an agitating transfer member such as a screw member to the surface of a developer carrier such as a developing sleeve, and transfers the developer to a region facing an image carrier in accordance with the surface movement of the developer carrier. Then, by transferring the toner contained in the developer to a latent image on the image carrier, the latent image is developed, and a toner image is obtained. The developer used in the developing process is returned to the agitating transfer member in the developing device in accordance with the surface movement of the developer carrier, whereupon the toner concentration is detected by toner concentration detecting means as the developer is transferred by the agitating transfer member. Then, on the basis of the detection result, an appropriate amount of toner is added, whereupon the developer is supplied to the developer carrier again.

In a developing device constituted in this manner, when the volume of toner in the developer varies due to environmental variation and variation in the toner charge, the detection result produced by the toner concentration detecting means varies regardless of whether the toner concentration is constant or not, and as a result, a detection error occurs. Such detection errors can be suppressed by pushing the developer forcibly into a detection position of the toner concentration detecting means such that the toner volume is appropriate for the toner concentration.

FIG. 10 of Japanese Unexamined Patent Application Publication H6-308833, for example, is a graph illustrating that a constant detection result can be obtained by a permeability sensor serving as the toner concentration detecting means, regardless of the toner charge, by pressurizing the developer to a force of 30 [g/cm$^2$] (9.8×300N/cm$^2$) or more.

However, in an experiment performed by the present inventors, it was found that in actuality, the permeability sensor does not always exhibit the output characteristics shown in the graph. More specifically, the developing device described in Japanese Unexamined Patent Application Publication H6-308833 transfers the developer in a rotary axis direction in accordance with the rotation of a screw member serving as an agitating transfer member, which is disposed in a developer transfer portion. The toner concentration of the transferred developer is then detected by the toner concentration detecting means, which are fixed to a lower wall of the developer transfer portion. On a downstream side of a toner concentration detection position of the toner concentration detecting means in the developer transfer direction, surface roughening processing is implemented on an inner wall of the developer transfer portion. Then, by reducing the developer transfer speed in the location of the surface roughening processing, the developer in a toner concentration detection position on the upstream side thereof in the developer transfer direction is pressurized in the developer transfer direction. However, according to the experiment performed by the present inventors, with this constitution, a favorable correlation is not exhibited between the pressurizing force applied to the developer in the developer transfer direction and the detection result produced by the permeability sensor serving as the toner concentration detection sensor.

Hence, after performing another experiment, the present inventors found that the reason for being unable to obtain a favorable correlation between the pressurizing force applied to the developer in the developer transfer direction and the detection result produced by the toner concentration detection sensor is as follows. A certain degree of clearance is provided between the wall of the developer transfer portion enveloping the screw member and the screw vane of the screw member. The toner concentration detection sensor fixed to the wall of the developer transfer portion has a comparatively small detectable distance range, and cannot therefore detect the toner concentration of the developer in the part of the screw vane positioned at a comparatively large remove therefrom. In other words, only the toner concentration of the developer in the clearance in the vicinity of the toner concentration detection sensor can be detected by the sensor. Accordingly, the developer in the clearance must be pressurized sufficiently. However, the pressurizing force in the rotary axis direction (transfer direction) accompanying rotation of the screw member acts mainly on the developer stored in the screw vane of the screw member. Therefore, even when the developer in the screw vane is pressurized sufficiently, the developer in the clearance on the outside of the screw vane is not pressurized sufficiently.

As a result, a favorable correlation cannot be obtained between the pressurizing force applied to the developer in the developer transfer direction and the detection result produced by the toner concentration detection sensor.

Meanwhile, Japanese Unexamined Patent Application Publication H5-341649 describes a developing device in which a parallel fin member extending in a parallel direction to the rotary axis direction protrudes from a peripheral surface of a rotary shaft member of a screw member, and a toner concentration sensor is disposed in a region facing the parallel fin member. According to this constitution, the developer is moved in a normal line direction by the parallel fin member and at the same time is pressurized toward the toner concentration sensor. Thus, the toner positioned in the vicinity of a toner concentration detection surface of the sensor is pushed forcibly toward the sensor. As a result, the number of toner concentration detection errors can be reduced in comparison with the developing device described in Japanese Unexamined Patent Application Publication H6-308833.

However, the present inventors discovered through experiment that even with this developing device, the developer in the vicinity of the toner concentration detection sensor cannot be pressurized sufficiently, and therefore detection errors may occur.

Technologies relating to the present invention are also disclosed in, e.g., Japanese Unexamined Patent Application Publication S63-049569, Japanese Unexamined Patent Application Publication S64-038718, Japanese Unexamined Patent Application Publication H11-202610, Japanese Unexamined Patent Application Publication 2003-215903, and Japanese Unexamined Patent Application Publication 2003-307918.

SUMMARY OF THE INVENTION

The present invention has been designed in consideration of the background described above, and it is an object thereof to provide a developer transferring device which is capable of reducing toner concentration detection errors caused by variation in toner volume in comparison with the related art, and a developing device, a process unit, and an image forming apparatus using the developer transferring device.

In an aspect of the present invention, a developer transferring device comprises a rotatably supported rotary shaft member; a developer transferring portion for transferring a developer containing a toner and a carrier in a rotary axis direction while agitating the developer as a screw member having a screw vane that protrudes in spiral form from a peripheral surface of the rotary shaft member rotates; and a toner concentration detecting device for detecting a toner concentration of the developer transferred within the developer transferring portion. Of an entire rotary axis direction region of the screw member, a reverse transfer vane for transferring the developer in an opposite direction to the screw vane as the rotary shaft member rotates protrudes from the rotary shaft member in a region where a gravitational direction lower side faces a bottom wall of the developer transferring portion and two lateral sides that are orthogonal to the rotary axis direction face respective side walls of the developer transferring portion. The toner concentration detecting device are disposed to detect the toner concentration of the developer as the developer is transferred between the reverse transfer vane and a location of the screw vane adjacent to the reverse transfer vane.

In another aspect of the present invention, a developer transferring device comprises a rotatably supported rotary shaft member; a developer transferring portion for transferring a developer containing a toner and a carrier in a rotary axis direction while agitating said developer as a screw member having a screw vane that protrudes in spiral form from a peripheral surface of said rotary shaft member rotates; and a toner concentration detecting device for detecting a toner concentration of said developer transferred within said developer transferring portion. A transfer vane for transferring said developer in a relatively identical direction to said screw vane but at a higher speed than said screw vane as said rotary shaft member rotates protrudes from a location of said rotary shaft member between two opposing surfaces of said screw vane that oppose each other in said rotary axis direction.

In another aspect of the present invention, a developer transferring device comprises a rotatably supported rotary shaft member; a developer transferring portion for transferring a developer containing a toner and a carrier in a rotary axis direction while agitating the developer as a screw member having a screw vane that protrudes in spiral form from a peripheral surface of the rotary shaft member rotates; and a toner concentration detecting device for detecting a toner concentration of the developer transferred within the developer transferring portion. A bridging vane for bridging two opposing surfaces of the screw vane that oppose each other in the rotary axis direction protrudes from the rotary shaft member. The toner concentration detecting means are disposed to detect the toner concentration of at least the developer that is agitated by the bridging vane.

In another aspect of then present invention, a developing device comprises a developer transferring device for transferring a developer containing a toner and a carrier; and a developer carrier for developing a latent image carried on an image carrier by carrying the developer transferred by the developer transferring device on a surface thereof that performs an endless motion so as to transfer the developer to a region facing the image carrier in accordance with the endless motion thereof. The developer transferring device comprises a rotatably supported rotary shaft member; a developer transferring portion for transferring the developer containing the toner and the carrier in a rotary axis direction while agitating the developer as a screw member having a screw vane that protrudes in spiral form from a peripheral surface of the rotary shaft member rotates; and a toner concentration detecting device for detecting a toner concentration of the developer transferred within the developer transferring portion. A reverse transfer vane for transferring the developer in an opposite direction to the rotary shaft member in a region of an entire rotary axis direction region of the screw member where a gravitational direction lower side faces a bottom wall of the developer transferring portion and two lateral sides that are orthogonal to the rotary axis direction face respective side walls of the developer transferring portion. The toner concentration detecting device are disposed to detect the toner concentration of the developer as the developer is transferred between the reverse transfer vane and a location of the screw vane adjacent to the reverse transfer vane.

In another aspect of the present invention, a process unit is provided in which at least an image carrier for carrying a latent image and a developing device for developing the latent image on the image carrier in an image forming apparatus comprising the image carrier, the developing device, and a transferring device for transferring a visible image developed on the image carrier onto a transfer body are held in a common holder as a single unit and inserted into and detached from a main body of the image forming apparatus integrally. The developing device comprises a developer transferring device for transferring a developer containing a toner and a carrier; and a developer carrier for developing the latent image carried on the image carrier by carrying the developer transferred by the developer transferring device on a surface thereof that performs an endless motion so as to transfer the developer to a region facing the image carrier in accordance with the endless motion thereof. The developer transferring device comprises a rotatably supported rotary shaft member; a developer transferring portion for transferring the developer containing the toner and the carrier in a rotary axis direction while agitating the developer as a screw member having a screw vane that protrudes in spiral form from a peripheral surface of the rotary shaft member rotates; and a toner concentration detecting device for detecting the developer transferring portion. A reverse transfer vane for transferring the developer in an opposite direction to the screw vane as the rotary shaft member rotates protrudes from the rotary shaft member in a region of an entire rotary axis direction region of the screw member where a gravitational direction lower side faces a bottom wall of the developer transferring portion and two lateral sides that are orthogonal to the rotary axis direction face respective side walls of said developer transferring portion. The toner concentration detecting device is disposed to detect the toner concentration of the developer as the developer is the screw vane adjacent to the reverse transfer vane.

In another aspect of the present invention, an image forming apparatus comprises an image carrier for carrying a latent image; and a developing device for developing the latent image on the image carrier. The developing device comprise a developer transferring device for transferring a developer containing a toner and a carrier; and a developer carrier for developing the latent image carried on the image carrier by carrying the developer transferred by the developer transferring device on a surface thereof that performs an endless motion so as to transfer the developer to a region facing the image carrier in accordance with the endless motion thereof. The developer transferring device comprises a rotatably supported rotary shaft member; a developer transferring portion for transferring the developer containing the toner and the carrier in a rotary axis direction while agitating the developer as a screw member having a screw vane that protrudes in spiral form from a peripheral surface of the rotary shaft member rotates; and a toner concentration detecting device for detecting a toner concentration of the developer transferred within the developer transferring portion. A reverse transfer vane for transferring the developer in an opposite direction to the screw vane as the rotary shaft member rotates protrudes from the rotary shaft member in a region of an entire rotary axis direction region of the screw member where a gravitational direction lower side faces a bottom wall of the developer transferring portion and two lateral sides that are orthogonal to the rotary axis direction face respective side walls of the developer transferring portion. The toner concentration detecting device are disposed to detect the toner concentration of the developer as the developer is transferred between the reverse transfer vane and a location of the screw vane adjacent to the reverse transfer vane.

BRIEF DESCRIPTION OF THE DRAWINGS

The above and other objects, features and advantages of the present invention will become more apparent from the following detailed description taken with the accompanying drawings, in which:

FIG. 10 is a table of potential control;

DESCRIPTION OF THE PREFERRED EMBODIMENT(S)

A first embodiment of an electrophotographic color copier serving as an image forming apparatus to which the present invention is applied will now be described.

Figure 1:
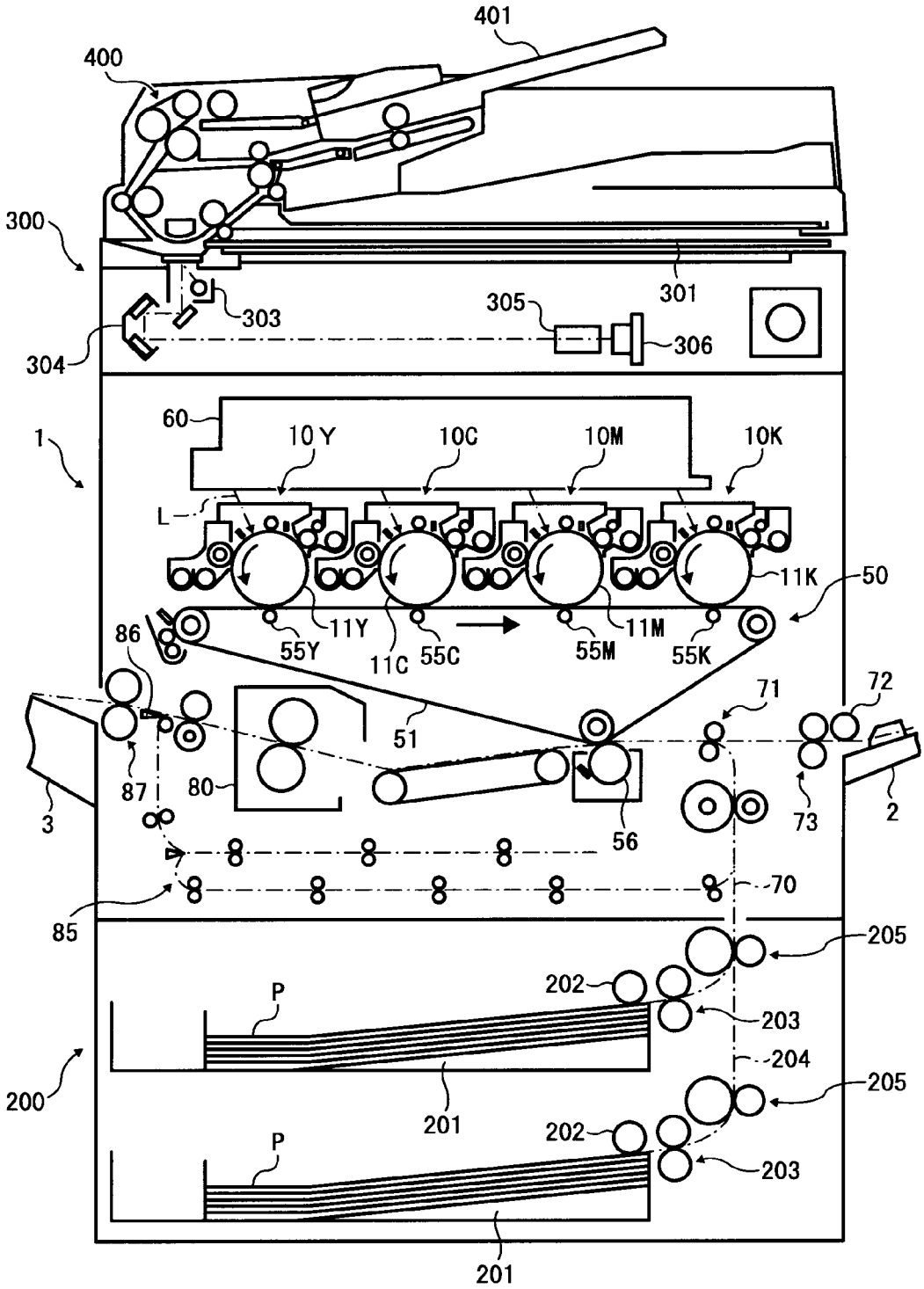
FIG. 1 is a view showing the schematic constitution of a copier according to a first embodiment.

FIG. 1 shows the schematic constitution of a color copier according to the first embodiment. This copier comprises a printer portion 1 for forming an image on a recording sheet, a sheet feeding device 200 for feeding a recording sheet P to the printer portion 1, a scanner 300 for reading an original image, an automatic document feeder (to be referred to hereafter as ADF) 400 for supplying an original to the scanner 300 automatically, and so on.

In the scanner 300, reading and scanning of an original, not shown in the drawing, which is placed on a contact glass 301, is performed as a first scanning body 303 installed with an original illumination light source, a mirror and so on, and a second scanning body 304 installed with a plurality of reflection mirrors reciprocate. Scanning light emitted from the second scanning body 304 is condensed by an imaging lens 305 onto an imaging surface of a reading sensor 306 disposed to the rear of the imaging lens 305, whereupon the scanning light is read as an image signal by the reading sensor 306.

A manual feeding tray 2 on which the recording sheet P to be fed into a housing is placed manually, and a discharge tray 3 on which recording sheets P that have been formed with images and discharged from the housing are stacked, are provided on a side face of the housing of the printer portion 1.

Figure 2:
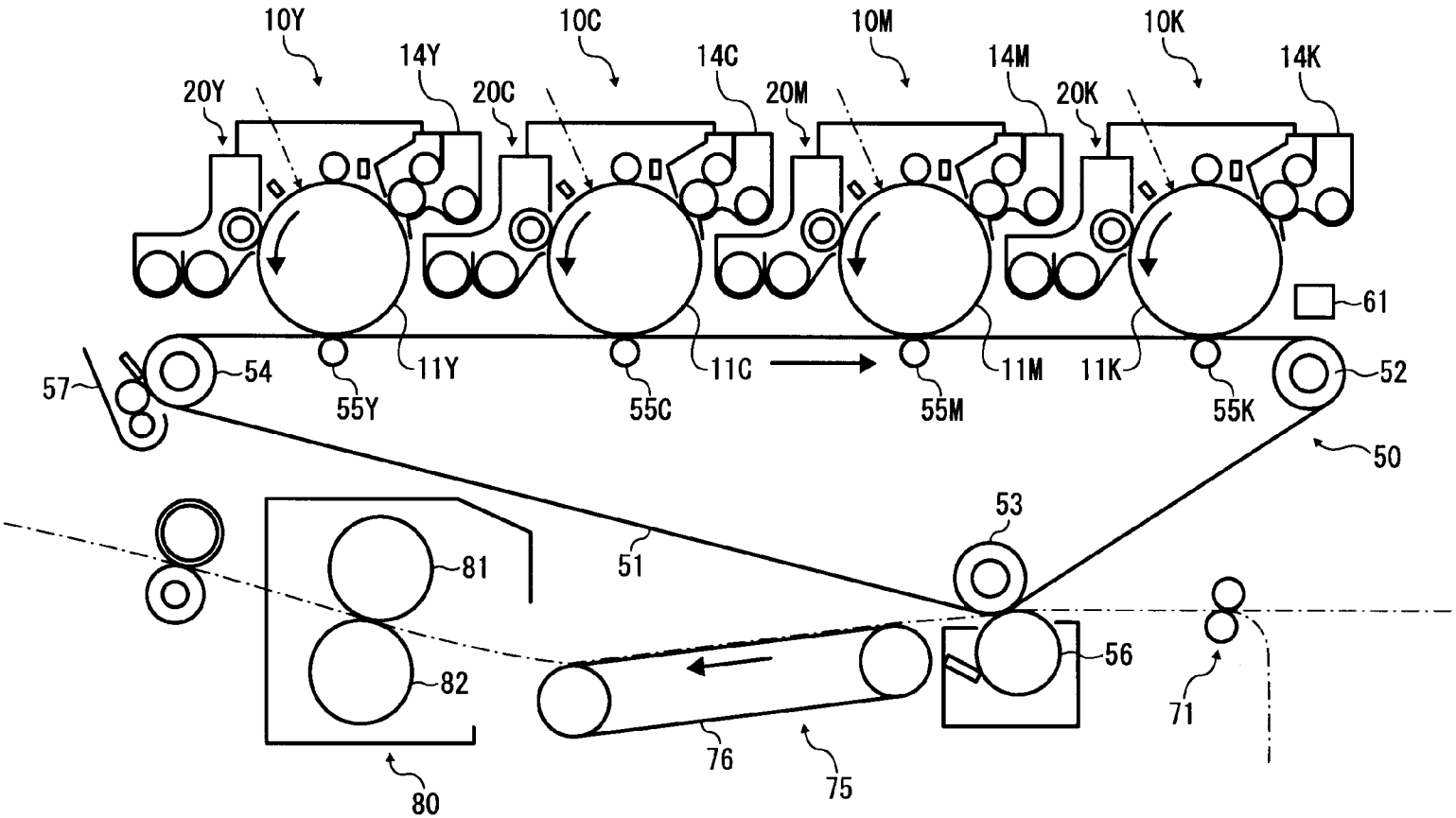
FIG. 2 is a view showing a partial enlargement of the interior constitution of a printer portion in the copier.

FIG. 2 shows a partial enlargement of the interior constitution of the printer portion 1. A transfer unit 50 serving as transfer means, in which an endless intermediate transfer belt 51 serving as a transfer body is stretched around a plurality of tension rollers, is provided in the housing of the printer portion 1. The intermediate transfer belt 51 is constituted by a material produced by dispersing carbon particles for adjusting electric resistance through a polyimide resin having little flexibility. The intermediate transfer belt 51 is stretched around a drive roller 52 that is driven to rotate in a clockwise direction of the drawing by driving means not shown in the drawing, a secondary transfer backup roller 53, a driven roller 54, and four primary transfer rollers 55Y, C, M, K, and performs an endless motion in the clockwise direction of the drawing as the drive roller 52 rotates. Note that the affixes Y, C, M, and K affixed to the end of the reference symbols for the primary transfer rollers indicate members used for yellow, cyan, magenta, and black ink, respectively. This applies likewise to the affixes Y, C, M, K affixed to the end of other reference symbols hereafter.

The intermediate transfer belt 51 curves greatly in the respective locations corresponding to the drive roller 52, the secondary transfer backup roller 53, and the driven roller 54, and is therefore stretched into a reverse triangular attitude, the base of which faces the upper side of the vertical direction. The belt upper portion stretched surface corresponding to the base of the reverse triangle extends in a horizontal direction, and four process units 10Y, C, M, K are disposed above the belt upper portion stretched surface so as to be aligned in a horizontal direction corresponding to the extension direction of the upper portion stretched surface.

In FIG. 1, an optical writing unit 60 is disposed above the four process units 10Y, C, M, K. On the basis of image information of the original read by the scanner 300, the optical writing unit 60 emits four writing beams L by driving four semiconductor lasers (not shown) using a laser control portion not shown in the drawing. Drum-shaped photosensitive bodies 11Y, C, M, K serving as image carriers of the process units 10Y, C, M, K are scanned through the dark by the writing beams L, and as a result, Y, C, M, and K electrostatic latent images are written onto the surfaces of the photosensitive bodies 11Y, C, M, K.

In the first embodiment, the optical writing unit 60 performs optical scanning by reflecting a laser beam emitted from the semiconductor lasers using a reflection mirror, not shown in the drawing, and allowing the laser beam to pass through an optical lens while deflecting the laser beam using a polygon mirror, not shown in the drawing. Instead of this constitution, optical scanning may be performed using an LED array.

Figure 3:
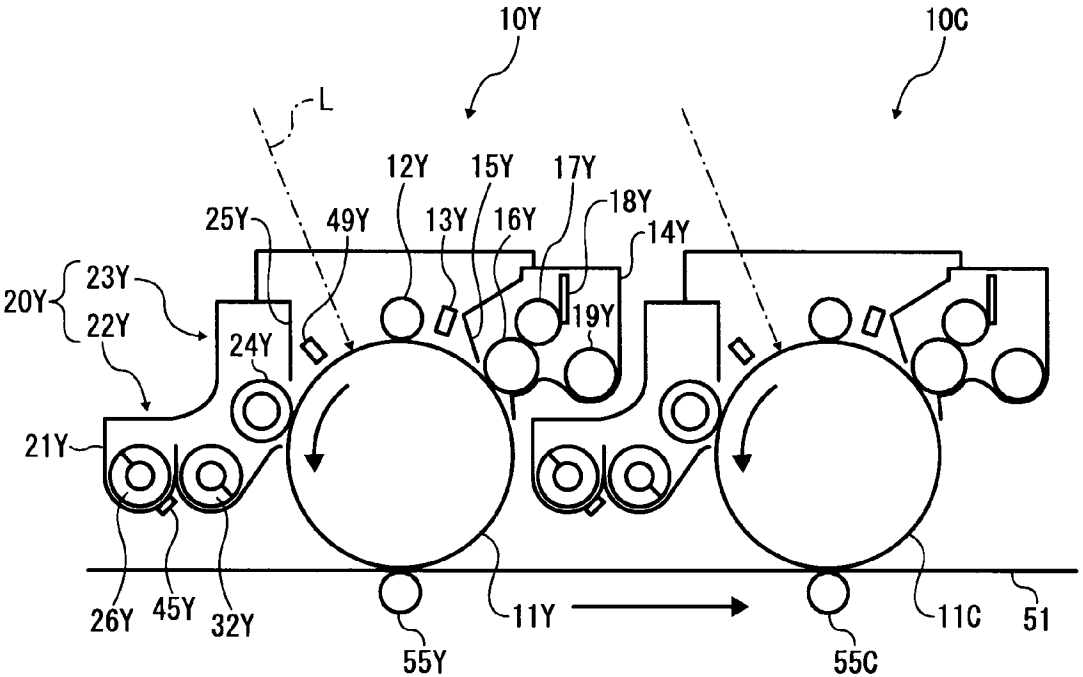
FIG. 3 is a view showing Y and C process units in the printer portion, together with an intermediate transfer belt.

FIG. 3 shows the Y and C process units 10Y, C together with the intermediate transfer belt 51. The Y process unit 10Y comprises a charging member 12Y, a neutralizing device 13Y, a drum cleaning device 14Y, a developing device 20Y serving as developing means, a potential sensor 49Y, and soon, all of which are provided on the periphery of the drum-shaped photosensitive body 11Y. These components are held in a casing serving as a common holder and inserted into or detached from the printer portion integrally as a single unit.

The charging member 12Y is a roller-shaped member that is supported rotatably by a bearing, not shown in the drawing, while contacting the photosensitive body 11Y. By contacting the photosensitive body 11Y rotationally while applying a charging bias thereto using bias supplying means, not shown in the drawing, the charging member 12Y applies a uniform charge having an identical polarity to the charging polarity of the Y toner, for example, to the surface of the photosensitive body 11Y. Instead of this constitution, a scorotron charger or the like for implementing uniform charging processing on the photosensitive body 11Y in a non-contact manner may be employed as the charging member 12Y.

The developing device 20Y, in which a Y developer containing a magnetic carrier, not shown in the drawing, and a non-magnetic Y toner is enveloped in a casing 21Y, comprises a developer transferring device 22Y and a developing portion 23Y. In the developing portion 23Y, a portion of a peripheral surface of a developing sleeve 24Y, which serves as a developer carrier that is driven to rotate by driving means not shown in the drawing so that the surface thereof performs an endless motion, is exposed to the outside through an opening provided in the casing 21Y. Thus, a developing region in which the photosensitive body 11Y and developing sleeve 24Y face each other via a predetermined gap is formed.

A magnet roller, not shown in the drawing, comprising a plurality of magnetic poles arranged in the circumferential direction, is fixed to the interior of the developing sleeve 24Y, which is constituted by a non-magnetic, hollow pipe-shaped member, so as not to be rotated by the developing sleeve 24Y. The developing sleeve 24Y rotates while adsorbing Y developer in the developer transferring device 22Y, to be described below, onto its surface using magnetic force generated by the magnet roller, and in so doing draws up the Y developer from the developer transferring device 22Y. The Y developer, which is transferred toward the developing region as the developing sleeve 24Y rotates, enters a doctor gap of 0.9 [mm] formed between a doctor blade 25Y, a tip end of which faces the surface of the developing sleeve 24Y via a predetermined gap, and the sleeve surface. At this time, the layer thickness on the sleeve is restricted to 0.9 [mm] at most. Then, when the Y developer is transferred to the vicinity of the developing region facing the photosensitive body 11Y as the developing sleeve 24Y rotates, the Y developer receives the magnetic force of a developing pole, not shown in the drawing, of the magnet roller. As a result, the Y developer ears so as to form a magnetic brush.

A developing bias having an identical polarity to the charging polarity of the toner, for example, is applied to the developing sleeve 24Y by bias supplying means, not shown in the drawing. Thus, in the developing region, a non-developing potential for statically moving the Y toner from a non-image portion side to the sleeve side acts between the surface of the developing sleeve 24Y and the non-image portion (uniformly charged site=background portion) of the photosensitive body 11Y. Further, a developing potential for statically moving the Y toner from the sleeve side toward the electrostatic latent image acts between the surface of the developing sleeve 24Y and the electrostatic latent image on the photosensitive body 11Y. By the action of the developing potential, the Y toner in the Y developer is transferred to the electrostatic latent image, and as a result, the electrostatic latent image on the photosensitive body 11Y is developed into a Y toner image.

The Y developer that passes through the developing region as the developing sleeve 24Y rotates receives the effect of a repulsion electric field formed between repulsion poles provided in the magnet roller, not shown in the drawing, and as a result, the Y developer is separated from the developing sleeve 24Y and returned to the developer transferring device 22Y.

The developer transferring device 22Y comprises two first screw members 26Y, a second screw member 32Y, a partition wall interposed between the screw members, a toner concentration detection sensor 45Y constituted by a permeability sensor, and so on. The partition wall separates a first transfer chamber serving as a developer transfer portion in which the first screw member 26Y is housed, and a second transfer chamber serving as a developer transfer portion in which the second screw member 32Y is housed. However, in a region facing the two end portions of the two screw members in the axial direction, the two transfer chambers communicate with each other via respective openings, not shown in the drawing.

The first screw member 26Y and second screw member 32Y, which serve as agitating transfer members, each comprise a rod-shaped rotary shaft member, the two end portions of which are supported rotatably by a bearing not shown in the drawing, and a screw vane protruding in spiral form from the peripheral surface of the rotary shaft member. The respective screw members are driven to rotate by driving means not shown in the drawing, whereby the Y developer is transferred in the rotary axis direction by the screw vane.

In the first transfer chamber housing the first screw member 26Y, the Y developer is transferred from the front side to the rear side in an orthogonal direction to the paper surface as the first screw member 26Y rotates. Then, having been transferred to the vicinity of the rear side end portion of the casing 21Y, the Y developer enters the second transfer chamber through the opening, not shown in the drawing, provided in the partition wall.

The aforesaid developing portion 23Y is formed above the second transfer chamber housing the second screw member 32Y, and the second transfer chamber and developing portion 23Y communicate with each other over the entire region in which they face each other. Thus, the second screw member 32Y and the developing sleeve 24Y disposed diagonally thereabove face each other while maintaining a parallel relationship. In the second transfer chamber, the Y developer is transferred from the rear side to the front side in an orthogonal direction to the paper surface as the second screw member 32Y rotates. In this transfer process, the Y developer on the periphery of the second screw member 32Y in the rotary direction is taken up into the developing sleeve 24Y as appropriate, and collected from the developing sleeve 24Y following development as appropriate. Having been transferred to the vicinity of the front side end portion, in the drawing, of the second transfer chamber, the Y developer returns to the first transfer chamber through the opening, not shown in the drawing, provided in the partition wall.

The toner concentration detection sensor 45Y, which is constituted by a permeability sensor and serves as toner concentration detecting means, is fixed to a lower wall of the first transfer chamber for detecting the toner concentration of the Y developer transferred by the first screw member 26Y from below and outputting a voltage corresponding to the detection result. If necessary, a control portion, not shown in the drawing, drives a Y toner adding device, not shown in the drawing, on the basis of the output voltage value from the toner concentration detection sensor 45Y to add an appropriate amount of Y toner to the first transfer chamber. Thus, the toner concentration of the Y developer is restored following a decrease therein due to development.

The Y toner image formed on the photosensitive body 11Y is subjected to primary transfer onto the intermediate transfer belt 51 at a Y primary transfer nip to be described below. After passing through the primary transfer process, transfer residual toner that was not subjected to primary transfer onto the intermediate transfer belt 51 remains adhered to the surface of the photosensitive body 11Y.

The drum cleaning device 14Y cantilevers a cleaning blade 15Y constituted by polyurethane rubber or the like, for example, such that the free end side thereof contacts the surface of the photosensitive body 11Y. Further, a brush tip end side of a brush roller 16Y, which comprises a rotary shaft member that is driven to rotate by driving means not shown in the drawing and a large number of conductive naps standing upright on the peripheral surface thereof, contacts the photosensitive body 11Y. The transfer residual toner described above is removed from the surface of the photosensitive body 11Y by the cleaning blade 15Y and brush roller 16Y. A cleaning bias is applied to the brush roller 16Y via a metallic electric field roller 17Y in contact therewith, and the tip end of a scraper 18Y is pressed against the electric field roller 17Y. The transfer residual toner removed from the photosensitive body 11Y by the cleaning blade 15Y and brush roller 16Y passes the brush roller 16Y and electric field roller 17Y and is then removed from the electric field roller 17Y by the scraper 18Y and dropped onto a collection screw 19Y. The transfer residual toner is discharged to the exterior of the casing as the collection screw 18Y rotates, and then returned to the developer transferring device 22Y via toner recycling transferring means not shown in the drawing.

The surface of the photosensitive body 11Y from which the transfer residual toner is removed by the drum cleaning device 14Y is neutralized by the neutralizing device 13Y, which is constituted by an antistatic lamp or the like, and then uniformly charged again by the charging member 14Y.

Further, the potential of the non-image portion of the photosensitive body 11Y that has passed the optical writing position of the writing beam L is detected by a potential sensor 49Y, and the detection result is transmitted to the control portion not shown in the drawing.

Note that the photosensitive body 11Y having a diameter of 60 [mm] is driven to rotate at a linear speed of 282 [mm/sec]. Further, the developing sleeve 24Y having a diameter of 25

[mm] is driven to rotate at a linear speed of 564 [mm/sec]. The charge of the toner in the developer that is supplied to the developing region is set within a range of approximately −10 to −30 [μC/g]. The developing gap between the photosensitive body 11Y and the developing sleeve 24Y is set within a range of 0.5 to 0.3 mm. The thickness of the photosensitive layer of the photosensitive body 11Y is 30 [μm]. The beam spot diameter of the writing beam L on the photosensitive body 11Y is 50×60 [μm], and the light amount thereof is approximately 0.47 [mW]. The uniform charge potential of the photosensitive body 11Y is −700 [V], for example, and the potential of the electrostatic latent image is −120 [V]. Further, the voltage of the developing bias is −470 [V], for example, whereby a developing potential of 350 [V] is secured.

The Y process unit 10Y will now be described in detail. The process units (10C, M, K) for the other colors have a similar constitution to the Y process unit 10Y, differing only in the color of the used toner.

Returning to FIG. 2, the photosensitive bodies 11Y, C, M, K of the process units 10Y, C, M, K rotate while contacting the upper portion stretched surface of the intermediate transfer belt 51 as it moves endlessly in the clockwise direction, thereby forming Y, C, M, K primary transfer nips. On the rear side of the Y, C, M, K primary transfer nips, the aforesaid primary transfer rollers 55Y, C, M, K contact the rear surface of the intermediate transfer belt 51. A primary transfer bias having an opposite polarity to the charging polarity of the toner is applied to the primary transfer rollers 55Y, C, M, K respectively by bias supplying means not shown in the drawing. As a result of the primary transfer bias, a primary transfer electric field for causing the toner to move statically from the photosensitive body side to the belt side is formed in the Y, C, M, K primary transfer nips. When the Y, C, M, K toner images formed on the photosensitive bodies 11Y, C, M, K enter the Y, C, M, K primary transfer nips as the photosensitive bodies 11Y, C, M, K rotate, the Y, C, M, K toner images are superposed on the intermediate transfer belt 51 in sequence by the primary transfer electric field and the nip pressure, and thus primary transfer is performed. As a result, a four-color superposed toner image (to be referred to hereafter as a four-color toner image) is formed on the front surface (the outer peripheral surface of the loop) of the intermediate transfer belt 51. Note that instead of the primary transfer rollers 55Y, C, M, K, a conductive brush applied with a primary transfer bias, a non-contact type corona charger, and so on may be employed.

Figure 4:
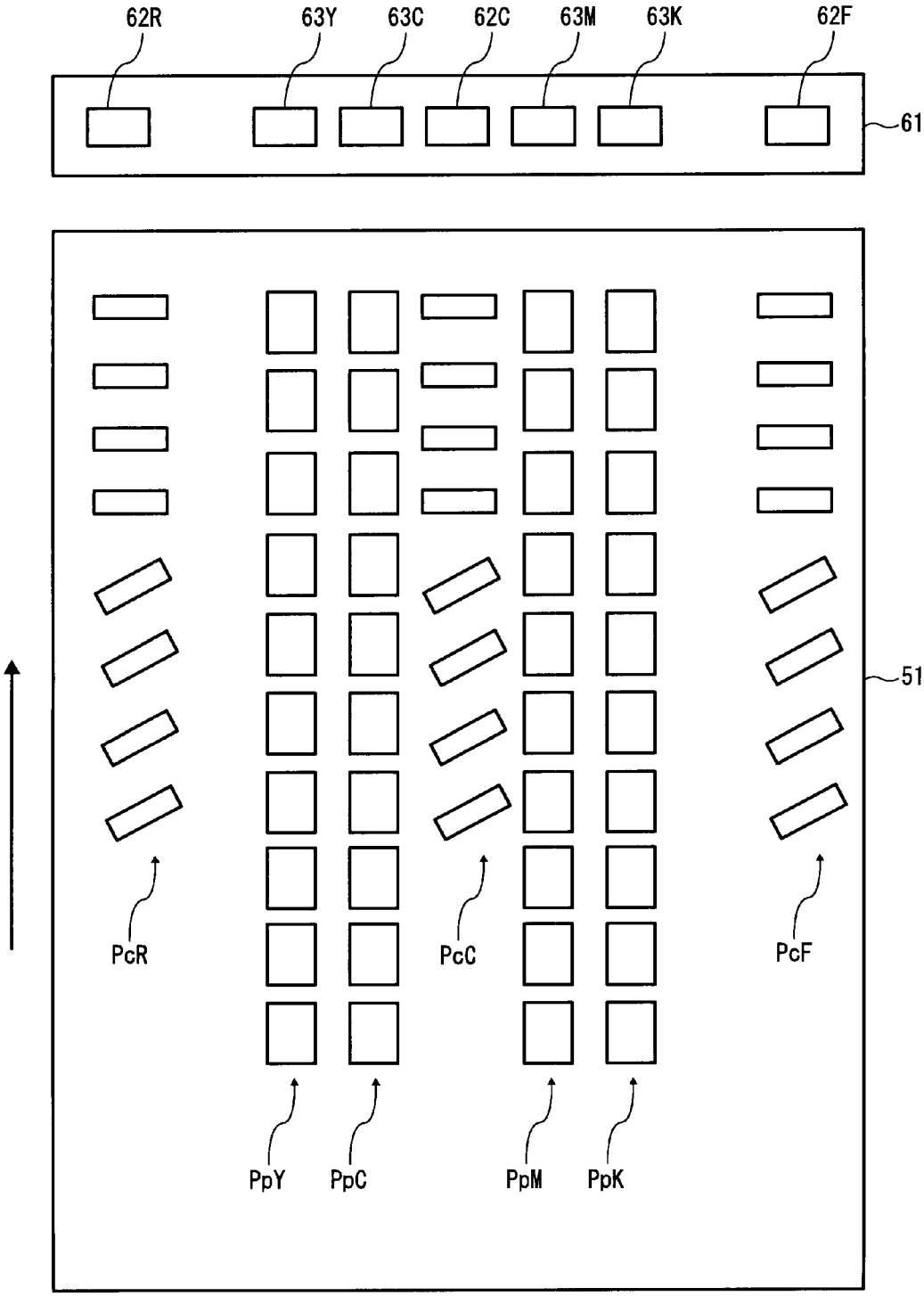
FIG. 4 is a plan view showing an optical sensor unit and the intermediate transfer belt in the printer portion.

An optical sensor unit 61 is disposed on the right side of the K process unit 10K in the drawing so as to face the front surface of the intermediate transfer belt 51 via a predetermined gap. As shown in FIG. 4, the optical sensor unit 61 comprises a rear side position detection sensor 62R, a Y image concentration detection sensor 63Y, a C image concentration sensor 63C, a central position detection sensor 62C, an M image concentration detection sensor 63M, a K image concentration detection sensor 63K, and a front side position detection sensor 62F, which are arranged in the width direction of the intermediate transfer belt 51. All of these sensors are constituted by reflection photosensors for reflecting light emitted from a light-emitting element not shown in the drawing on the front surface of the intermediate transfer belt 51 or the toner image on the belt and detecting the reflection light amount using a light-receiving element not shown in the drawing. The control portion, not shown in the drawing, is capable of detecting a toner image on the intermediate transfer belt 51 and the image concentration (toner adhesion amount per unit area) thereof on the basis of an output voltage value from the sensors.

As shown in FIG. 3, a secondary transfer roller 56 is disposed below the intermediate transfer belt 51. The secondary transfer roller 56 contacts the front surface of the intermediate transfer belt while being driven to rotate in the counter-clockwise direction of the drawing by driving means not shown in the drawing, and thereby forms a secondary transfer nip. An electrically grounded secondary transfer backup roller 53 is disposed on the rear side of the secondary transfer nip via the intermediate transfer belt 51.

A secondary transfer bias having an opposite polarity to the charging polarity of the toner is applied to the secondary transfer roller 56 by bias supplying means not shown in the drawing, and as a result, a secondary transfer electric field is formed between the secondary transfer roller 56 and the grounded secondary transfer backup roller 53. The four-color toner image formed on the front surface of the intermediate transfer belt 51 enters the secondary transfer nip in accordance with the endless motion of the intermediate transfer belt 51.

Returning to FIG. 1, the sheet feeding device 200 is provided with a plurality of each of a sheet feeding cassette 201 storing the recording sheets P, a sheet feeding roller 202 for conveying the recording sheets P stored in the sheet feeding cassettes 201 to the outside of the cassettes, a separating roller pair 203 for separating the conveyed recording sheets P into single sheets, a transfer roller pair 205 for transferring the separated sheet P along a conveyance path 204, and so on. As shown in the drawing, the sheet feeding device 200 is disposed immediately beneath the printer portion 1. The conveyance path 204 of the sheet feeding device 200 communicates with a sheet feeding path 70 of the printer portion 1. Hence, after being conveyed from the sheet feeding cassette 201 of the sheet feeding device 200, the recording sheet P is conveyed onto the sheet feeding path 70 of the printer portion 1 via the conveyance path 204.

A resist roller pair 71 is disposed near the terminal end of the sheet feeding path 70 in the printer portion 1, and at a timing for achieving synchronization with the four-color toner image on the intermediate transfer belt 51, the recording sheet P sandwiched between the rollers is conveyed to the secondary transfer nip. In the secondary transfer nip, the four-color toner image on the intermediate transfer belt 51 is secondary-transferred in one go onto the recording sheet P by the secondary transfer electric field and the nip pressure, thereby forming a full color image that combines with the white of the recording sheet P. Having been formed with a full color image in this manner, the recording sheet P is discharged from the secondary transfer nip and separated from the intermediate transfer belt 51.

A transfer belt unit 75 in which an endless sheet transferring belt 76 is stretched around a plurality of tension rollers so as to perform an endless motion in the counter-clockwise direction of the drawing is disposed on the left side of the secondary transfer nip in the drawing. Having been separated from the intermediate transfer belt 51, the recording sheet P is passed onto the upper portion stretched surface of the sheet transferring belt 76 and transferred toward a fixing device 80.

Having been conveyed into the fixing device 80, the recording sheet P is sandwiched in a fixing nip formed by a heating roller 81 enveloping a heat generating source such as a halogen lamp, not shown in the drawing, and a pressure roller 82 pressed against the heating roller 81. Through the application of heat and pressure, the full color image is fixed onto the surface of the recording sheet P as the recording sheet P is conveyed toward the exterior of the fixing device 80.

A small amount of secondary transfer residual toner that was not transferred onto the recording sheet P remains adhered to the surface of the intermediate transfer belt 51 after the recording sheet P passes through the secondary transfer nip. This secondary transfer residual toner is removed from the intermediate transfer belt 51 by a belt cleaning device 57 contacting the front surface of the belt.

In FIG. 1, a switchback device 85 is disposed beneath the fixing device 80. When the recording sheet P discharged from the fixing device 80 reaches a transfer path switching position of a swingable switching pawl 86, the recording sheet P is conveyed toward a discharge roller pair 87 or the switchback device 85 in accordance with the swing stopping position of the switching pawl 86. When conveyed toward the discharge roller pair 87, the recording sheet P is discharged to the exterior of the copier and stacked on the discharge tray 3.

On the other hand, when the recording sheet P is conveyed toward the switchback device 85, the upper and lower surfaces thereof are reversed through switchback transfer performed by the switchback device 85, whereupon the recording sheet P is transferred back to the resist roller pair 71. The recording sheet P then enters the secondary transfer nip again, where a full color image is formed on the other surface thereof.

A recording sheet P that is placed manually on the manual feeding tray 2 provided on the side face of the housing of the printer portion 1 passes a manual supply roller 72 and a manual separating roller pair 73, and is then conveyed toward the resist roller pair 71. The resist roller pair 71 may be grounded or applied with a bias for removing paper particles of the recording sheet P therefrom.

When copying an original using the copier according to the first embodiment, first, an original is set on an original table 401 of the automatic document feeder 400. Alternatively, the automatic document feeder 400 is opened and an original is set on the contact glass 301 of the scanner 300, whereupon the automatic document feeder 400 is closed. When a start switch, not shown in the drawing, is pressed and an original is set in the automatic document feeder 400, the original is conveyed to the contact glass 301. The scanner 300 is then driven to begin reading and scanning by the first scanning body 303 and second scanning body 304. At substantially the same time, the transfer unit 50 and the process units 10Y, C, M, K of the respective colors are driven. Further, the recording sheet P is conveyed from the sheet feeding device 200. Note that when a recording sheet P not set in the sheet feeding cassette 201 is used, a recording sheet P set on the manual feeding tray 2 is conveyed.

Figure 5:
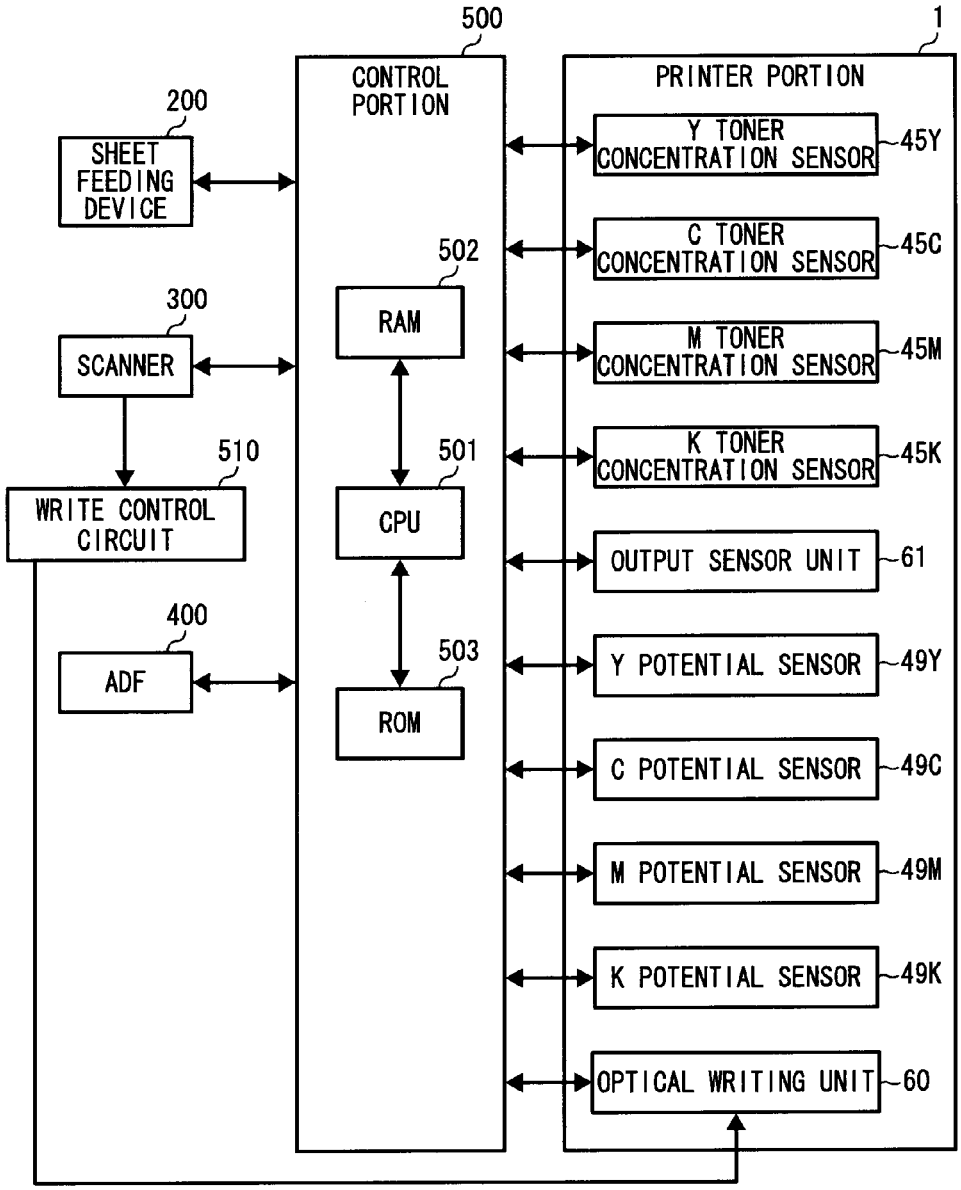
FIG. 5 is a block diagram showing a part of the constitution of an electric circuit in the copier.

FIG. 5 shows a part of the constitution of an electric circuit of the copier according to the first embodiment. As shown in the drawing, the copier comprises a control portion 500 for controlling various devices. In the control portion 500, ROM (Read Only Memory) 503 storing fixed data such as a computer program in advance and RAM (Random Access Memory) 502 functioning as a work area storing various data rewritably are connected to a CPU (Central Processing Unit) 501 for executing various calculations and drive-controlling each portion via a bus line. A concentration calculation data table indicating a relationship between the output voltage values from the image concentration sensors (63Y, C, M, K in FIG. 4) of the respective colors in the aforesaid optical sensor unit 61 and image concentrations corresponding thereto is stored in the ROM 503.

The printer portion 1, sheet feeding device 200, scanner 300, and ADF are connected to the control portion 500. For convenience, only the various sensors and the optical writing unit 60 are shown in the drawing as the internal devices of the printer portion 1, but other devices (for example, the transfer units and the process units of the respective colors) are also drive-controlled by the control portion 500. Output signals from the various sensors of the printer portion 1 are transmitted to the control portion 500.

Figure 6:
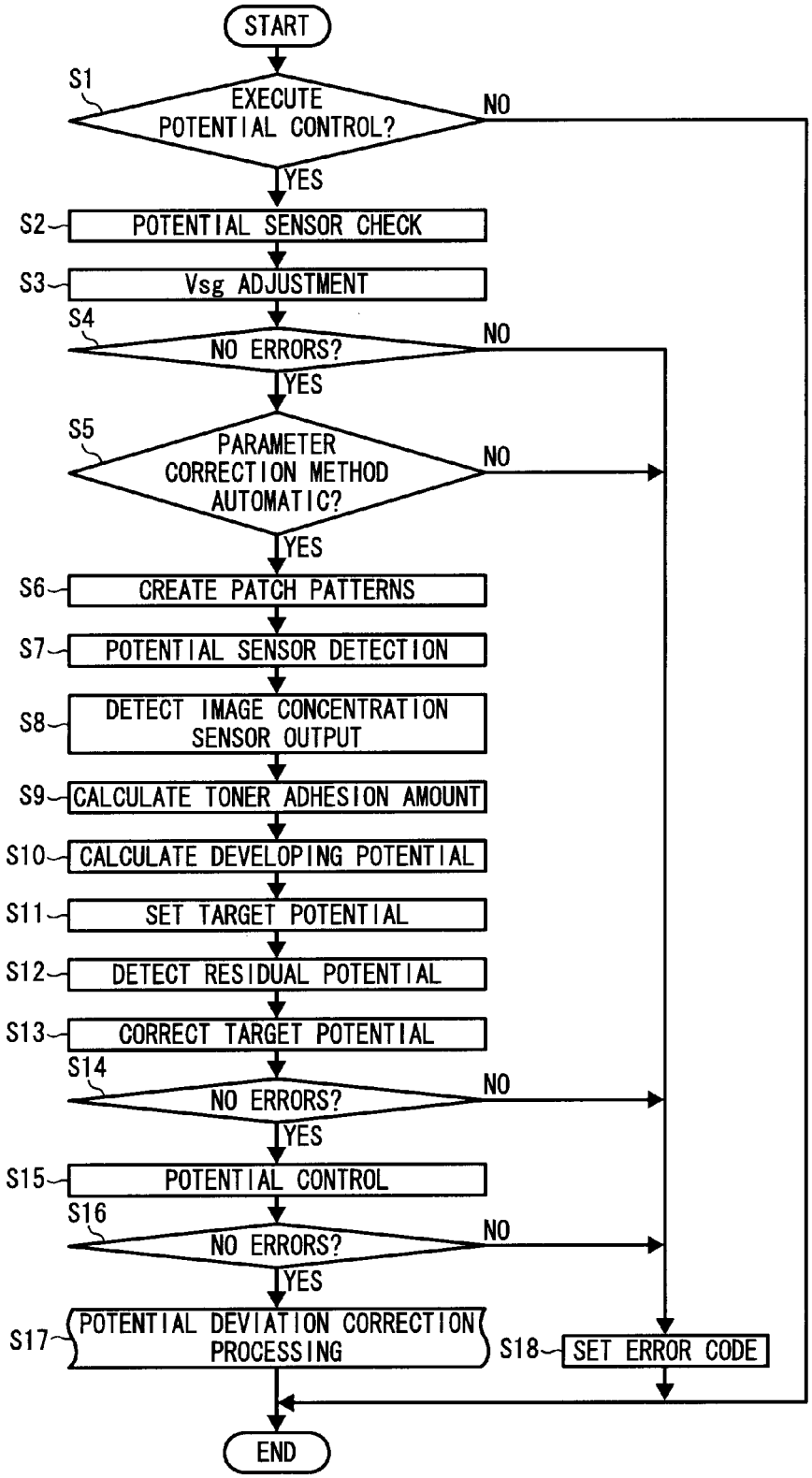
FIG. 6 is a flowchart showing the control flow of parameter correction processing implemented by a control portion of the copier.

FIG. 6 is a flowchart showing the control flow of parameter correction processing, implemented by the control portion 500. Parameter correction processing is performed at a predetermined timing such as upon activation of the copier, every time a predetermined number of copies have been made (between a preceding print operation and a following print operation during a continuous print operation), and at fixed time intervals, but FIG. 6 shows a processing flow performed upon activation. When parameter correction processing begins, first, to differentiate between the timing at which the power supply is switched OFF and irregularity processing performed during a jam or the like, the surface temperature of the heating roller in the fixing device 80 (to be referred to hereafter as the fixing temperature) is detected as a condition for executing the processing flow. Then, a determination is made as to whether or not the fixing temperature has exceeded 100[° C.], and if so (N in a step 1; hereafter, step will be abbreviated to S), it is determined that the power supply has not been switched off, and the processing flow is terminated.

When the fixing temperature does not exceed 100[° C.] (Y in S1), a potential sensor check is performed (S2). In the potential sensor check, the respective surface potentials of the photosensitive bodies (11Y to K) in the process units (10Y to K) of the respective colors, which have been uniformly charged under predetermined conditions, are detected by potential sensors (for example, 49Y in FIG. 3). Next, Vsg adjustment is performed on the optical sensor unit (61 in FIG. 4) (S3). In Vsg adjustment, the amount of light emitted by the light-emitting element is adjusted in relation to each sensor (62R, C, F, 63Y, C, M, K) such that the output voltage (Vsg) from the light-receiving element for detecting the light that is reflected on the non-image portion region of the intermediate transfer belt 51 takes a constant value. Note that in the processes of S2 and S3, the potential check and Vsg adjustment are performed in parallel for each color.

When Vsg adjustment is complete, a determination is made as to whether or not an error has occurred in the potential sensor check (S2) or Vsg adjustment (S3) (S4). When an error has occurred (N in S4), an error code corresponding to the error is set (S18), whereupon the control flow is terminated. When an error has not occurred (Y in S4), a determination is made as to whether or not a parameter correction method has been set automatically (S5). Note that the processing of S3 and S4 is executed regardless of the parameter correction method.

When a parameter correction method has not been set automatically (when the parameters are set at fixed values) (N in S5), an error code is set, whereupon the control flow is terminated. When a parameter correction method has been set automatically (Y in S5), the flow of the following steps S6 to S16 is executed.

In the process of S6, seven sets of toner patch patterns constituted by a plurality of reference toner images, as shown in FIG. 4, are formed on the front surface of the intermediate transfer belt 51. These toner patch patterns are arranged in series in the width direction of the intermediate transfer belt 51 so as to be detected by one of the seven sensors (62R, C, F, 63Y, C, M, K) provided in the optical sensor unit 61. The seven sets of toner patch patterns can be roughly divided into concentration gradation detection patch patterns and positional deviation detection patch patterns.

Figure 7:
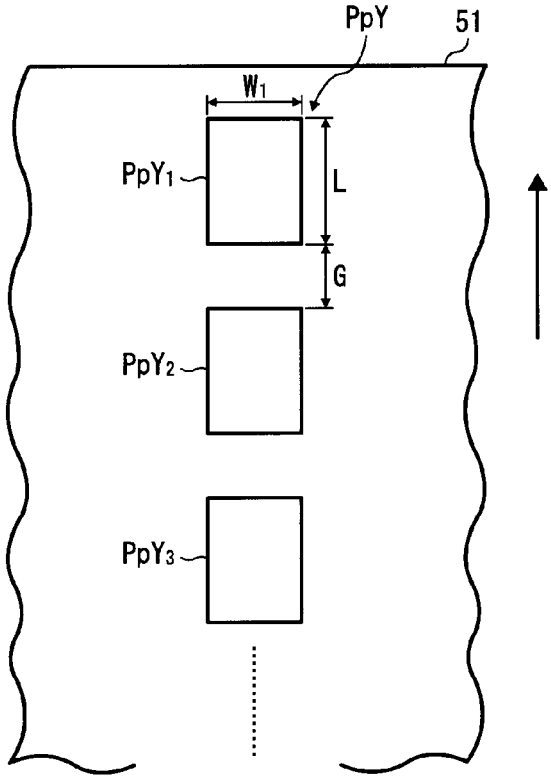
FIG. 7 is a plan view showing a patch pattern for detecting Y concentration gradation, together with the intermediate transfer belt.

In the concentration gradation detection patch patterns, Y, C, M, K concentration gradation detection patch patterns (PpY, PpC, PpM, PpK), constituted by a plurality of same-color reference toner images (a Y, C, M, or K reference toner image) having different image concentrations are formed individually and detected by the Y, C, M, K image concentration detection sensors 63Y, C, M, K. As shown in FIG. 7, the Y concentration gradation detection patch pattern PpY, for example, is constituted by n Y reference toner images, namely a first Y reference toner image PpYl, a second Y reference toner image PpY2, . . . , and an nth Y reference toner image PpYn, which are arranged at predetermined intervals G in the belt movement direction (shown by the arrow in the drawing). These reference toner images have different image concentrations, but their shape and attitude on the intermediate transfer belt 51 are the same. The reference toner images take a rectangular shape in which the width direction aligns with the belt width direction, the length direction aligns with the belt movement direction, a width W1 thereof is 15 [mm], and a length L1 thereof is 20 [mm]. Note that the interval G is 10 [mm]. Further, the interval between the differently colored patch patterns in the belt width direction is 5 [mm].

The reference toner images on the concentration gradation detection patch patterns (PpY, PpC, PpM, PpK) are formed on the photosensitive bodies (11Y, C, M, K) of the process units (10Y, C, M, K) of the respective colors and transferred onto the intermediate transfer belt 51. When the reference toner images pass directly beneath the image concentration detection sensors (63Y, C, M, K) in accordance with the endless motion of the intermediate transfer belt 51, the light issued from the sensors is reflected by the surfaces thereof. The amount of reflected light takes a value corresponding to the image concentration of the reference toner image. The control portion 500 stores a sensor output voltage value for each reference toner image of each color in the RAM 502 as Vpi (i=1 to N) (S8). Then, on the basis of the sensor output voltage value and the concentration calculation data table stored in advance in the ROM 503, the image concentration (the toner adhesion amount per unit area) of each reference toner image is specified, and the specification result is stored in the RAM 502 (S9). Note that before the concentration gradation detection patch patterns for each color are developed on the photosensitive body of each color, the potentials of respective reference latent images serving as the precursors of the reference toner images are detected by the aforesaid potential sensor, and the detection results are stored in sequence in the RAM 502 (S7).

Figure 8:
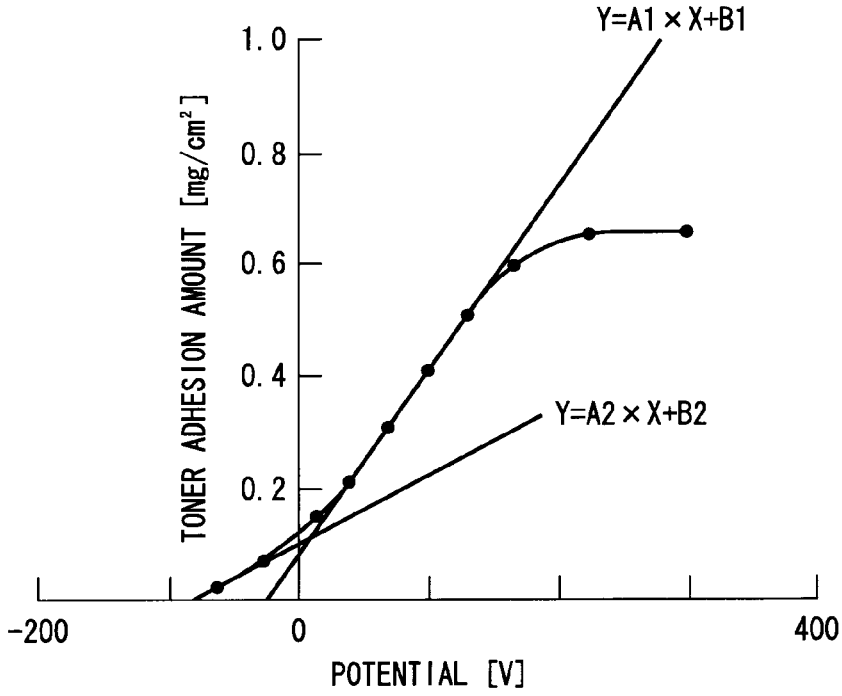
FIG. 8 is a graph showing the relationship between a toner adhesion amount and an electric potential.
Figure 9:
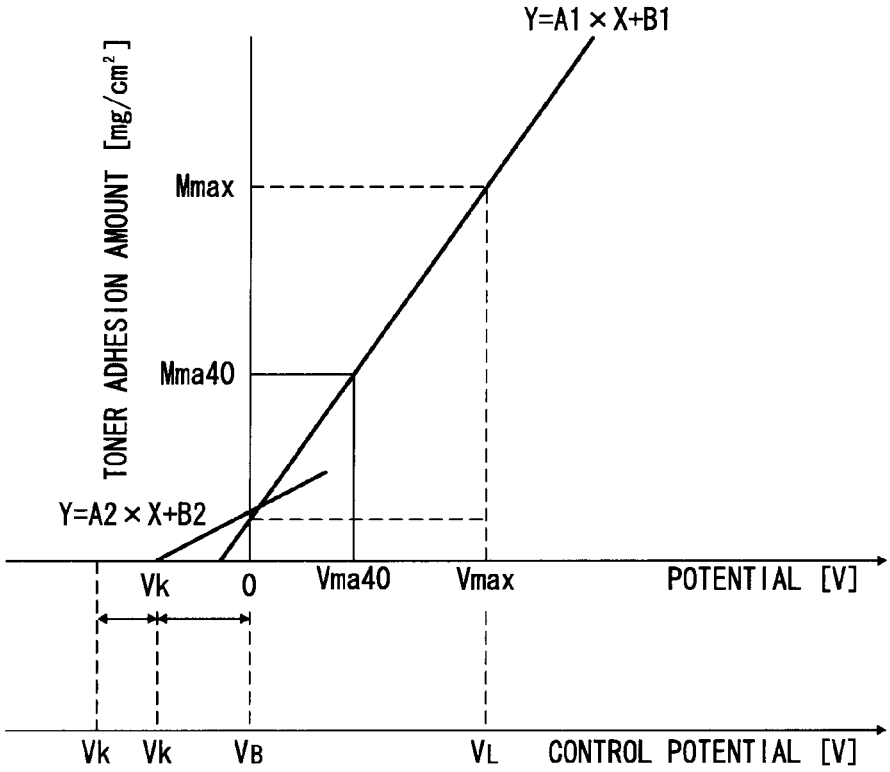
FIG. 9 is a graph illustrating the data of a section in which the relationship between the potential of a reference latent image and the toner adhesion amount becomes linear.

After specifying the toner adhesion amount in relation to the reference toner images of each color, appropriate developing potentials are determined for the developing device of each color (S10). More specifically, when the relationship between the potential of each reference latent image obtained in S7 and the toner adhesion amount obtained in S9 is plotted on an X-Y plane, for example, a graph such as that shown in FIG. 8 is obtained. In this drawing, the X axis shows the potential (the difference between the developing bias VB and the latent image potential), and the Y axis shows the toner adhesion amount per unit area [mg/cm$^2$]. As described above, reflection type photosensors are used as the sensors of the optical sensor unit 61. As shown in FIG. 8, the output voltage values of these sensors become saturated when the toner adhesion amount on the reference toner image increases considerably. Hence, when the toner adhesion amount is calculated using the sensor output voltage value of a reference toner image having a comparatively large toner adhesion amount as is, an error occurs. Therefore, as shown in FIG. 9, from a plurality of data combinations comprising the reference latent image potential and the toner adhesion amount on the reference toner image, only data combinations in a section where the relationship between the reference latent image potential and toner adhesion amount is linear are selected. Then, by applying a method of least squares to the data in this section, a linear approximation of the developing characteristic is obtained. On the basis of an approximate linear equation $(E)^i$ obtained for each color, the developing potential of each color is determined. Note that in this copier, regular reflection type photosensors are used, but diffuse reflection type photosensors may be used.

The following equations are used in the method of least squares.

$$Xave=\Sigma Xn/k \quad \text{Eq. (1)}$$

$$Yave=\Sigma Yn/k \quad \text{Eq. (2)}$$

$$Sx=\Sigma(Xn-Xave)\times(Xn-Xave) \quad \text{Eq. (3)}$$

$$Sy=\Sigma(Yn-Yave)\times(Yn-Yave) \quad \text{Eq. (4)}$$

$$Sxy=\Sigma(Xn-Xave)\times(Yn-Yave) \quad \text{Eq. (5)}$$

When the approximate linear equation (E) determined from the output value of the potential sensor of each color (the potential of the reference latent image of each color) and the toner adhesion amount on each reference toner image (the image concentration) is set as Y=A1×X+B1, coefficients A1, B1 may be expressed as $$A1=Sxy/Sx \quad \text{Eq. (6)}$$

$$B1=Yave-A1\times Xave \quad \text{Eq. (7)}$$

Further, a correlation coefficient R of the approximate linear equation (E) may be expressed as $$R\times R=(Sxy\times Sxy)/(Sx\times Sy) \quad \text{Eq. (8)}$$

Up to S9, five data sets,
(X1 to X5, Y1 to Y5)
(X2 to X6, Y2 to Y6)
(X3 to X7, Y3 to Y7)
(X4 to X8, Y4 to Y8)
(X5 to X9, Y5 to Y9)
(X6 to X10, Y6 to Y10)
are selected for each color in order from the lowest numerical value of potential data Xn, which are obtained from the reference latent image potential and toner adhesion amount, and toner adhesion amount data Yn following visualization, whereupon a linear approximation calculation is performed in accordance with Equations (1) to (8), and the correlation coefficient R is calculated to obtain the following six sets of approximate linear equations and correlation coefficients (9) to (14).

$$Y11=A11\times X+B11;\ R11 \quad \text{Eq. (9)}$$

$$Y12=A12\times X+B12;\ R12 \quad \text{Eq. (10)}$$

$$Y13=A13\times X+B13;\ R13 \quad \text{Eq. (11)}$$

$$Y14=A14\times X+B14;\ R14 \quad \text{Eq. (12)}$$

$$Y15=A15\times X+B15;\ R15 \quad \text{Eq. (13)}$$

$$Y16=A16\times X+B16;\ R16 \quad \text{Eq. (14)}$$

One set of approximate linear equations corresponding to the equations in which the correlation coefficient R11 to R16 takes a maximum value is selected from the obtained six approximate linear equation sets as the approximate linear equations (E).

Next, as shown in FIG. 9, the value of X when the value of Y reaches a required maximum toner adhesion amount Mmax in the approximate linear equations (E), or in other words a value Vmax of the developing potential, is calculated. The respective developing bias potentials VB in the developing device of each color and appropriate corresponding latent image potentials (exposure portion potentials) VL are obtained from the above equations using following Equations (15), (16).

$$Vmax=(Mmax-B1)/A1 \quad \text{Eq. (15)}$$

$$VB-VL=Vmax=(Mmax-B1)/A1 \quad \text{Eq. (16)}$$

The relationship between VB and VL may be expressed using a coefficient of the approximate linear equation (E).

Accordingly, Equation (16) becomes $$Mmax=A1\times Vmax+B1 \quad \text{Eq. (17)}$$

The relationship between a background portion potential VD, which is the pre-exposure potential of the photosensitive body, and the developing bias potential VB is obtained from an X coordinate VK (a developing start voltage of the developing device) of the intersection between a linear equation such as that shown in FIG. 9, i.e.

$$Y=A2\times X+B2 \quad \text{Eq. (18)}$$

and the X axis, and a staining leeway voltage Vα determined experientially by $$VD-VB=VK+V\alpha \quad \text{Eq. (19)}$$

Hence, the relationship between Vmax, VD, VB, and VL is determined from Equations (16) and (19). In this example, the relationship between the voltages (VD, VB, VL) is determined in advance through experiment or the like using Vmax as a reference value and turned into a table such as that shown in FIG. 10, which is then stored in the ROM 503 as a potential control table.

Next, the closest Vmax to the Vmax calculated for each color is selected from the potential control table, and the control voltages (potentials) VB, VD, VL corresponding to the selected Vmax are set as target potentials (S11).

Next, the residual potential of the photosensitive body is detected by controlling the laser emission power of the semiconductor laser of the optical writing unit 60 to a maximum light amount in relation to each color via a write control circuit 510 and importing the output value of the aforesaid potential sensor (S12). When the residual potential is not zero, correction is performed on the target potentials VB, VD, VL determined in S11 in accordance with the residual potential to obtain the target potentials.

Next, a determination is made as to whether or not an error occurred in S5 to S13 (S14). When an error occurs even in one color (N in S14), variation in the image concentration increases even when control is performed for the other colors, rendering subsequent processing meaningless, and therefore an error code is set (S18) and the control flow is terminated. In this case, the image creation conditions are left unchanged, and image creation is performed under the same image creation conditions until the parameter correction processing is successful.

When it is determined in S14 that no errors have occurred (Y), the electric circuits (not shown) of the respective colors are adjusted in parallel such that the background portion potential VD of the photosensitive body reaches the target potential. Next, the laser emission power of the semiconductor laser is adjusted via a laser control portion (not shown) such that the surface potential VL of the photosensitive body reaches the target potential. Further, in the developing device of each color, the electric circuit is adjusted such that the developing bias potential VB reaches the target potential (S15).

Next, a determination is made as to whether or not an error occurred in S15 (S16). If not (Y in S16), positional deviation correction processing, to be described below, is performed, whereupon the series of control processes is terminated. On the other hand, if an error occurred (N in S16), an error code is set and the control flow is terminated.

As shown in FIG. 4, the aforesaid positional deviation detection patch patterns include three sets of positional deviation detection patch patterns, namely rear side positional deviation detection patch patterns PcR formed near one end of the width direction of the intermediate transfer belt 51, central positional deviation detection patch patterns PcC formed in the center of the width direction, and front side positional deviation detection patch patterns PcR formed near the other end of the width direction. All of the positional deviation detection patch patterns are constituted by a plurality of reference toner images arranged in the belt movement direction, and each set of positional deviation detection patch patterns has reference toner images in the four colors Y, C, M, K. When no positional deviation exists in the photosensitive body and exposure optical system in each of the rear, the center, and the front, the reference toner images of each color are formed at equal intervals and in identical attitudes, but when positional deviation occurs, the formation interval or attitude thereof varies. Hence, in positional deviation correction processing (S17), aberrations in the formation interval and attitude are detected on the basis of a detection time interval of each reference toner image. Then, on the basis of the detection result, the tilt of a mirror in the exposure optical system is adjusted by a tilt correction mechanism, not shown in the drawing, or the exposure start timing is corrected, thereby reducing positional deviation in the toner image of each color.

Figure 11:
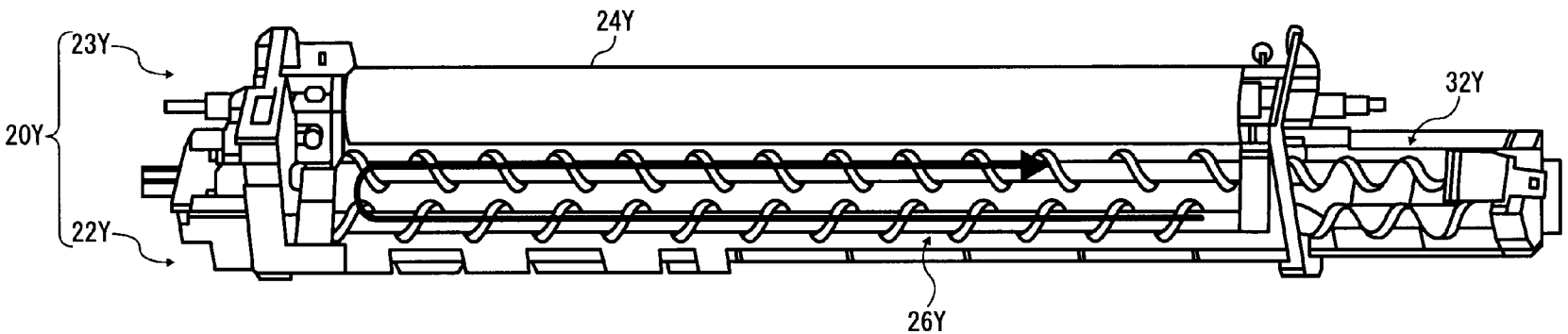
FIG. 11 is a perspective view showing a Y developing device in the printer portion.
Figure 12:
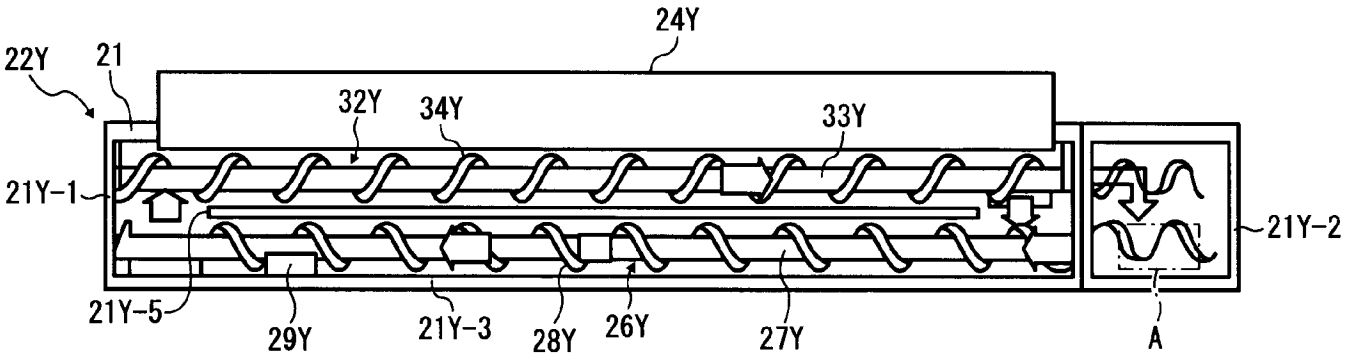
FIG. 12 is a plan view showing the developing device from above.

FIG. 11 shows the Y developing device 20Y. FIG. 12 shows the Y developing device 20Y from above. As described above, the developing device 20Y comprises the developing portion 23Y enveloping the developing sleeve 24Y, and the developer transferring device 22Y for agitating and transferring the Y developer. The developer transferring device 22Y comprises the first transfer chamber storing the first screw member 26Y serving as an agitating transfer member, and the second transfer chamber storing the second screw member 32Y serving as an agitating transfer member. The first screw member 26Y comprises a rotary shaft member 27Y, the two axial direction end portions of which are each supported rotatably by a bearing, and a screw vane 28Y protruding in spiral form from the peripheral surface of the rotary shaft member 27Y. The second screw member 32Y also comprises a rotary shaft member 33Y, the two axial direction end portions of which are each supported rotatably by a bearing, and a screw vane 34Y protruding in spiral form from the peripheral surface of the rotary shaft member 33Y.

The lateral periphery of the first screw member 26Y in the first transfer chamber serving as a developer transfer portion is surrounded by a casing wall. On the two sides of the first screw member 26Y positioned on either side of the axial direction, a rear side plate 21Y-1 and a front side plate 21Y-2 of the casing surround the first screw member 26Y from both sides of the axial direction. On one of the two sides of the first screw member 26Y positioned on either side of an orthogonal direction to the axial direction, a left side plate 21Y-3 of the casing, which serves as a side wall, extends in the rotary axis direction of the first screw member 26Y and faces the first screw member 26Y via a predetermined gap. On the other side, a partition wall 21Y-5 serving as a side wall for partitioning the first transfer chamber and second transfer chamber extends in the rotary axis direction of the first screw member 26Y and faces the first screw member 26Y via a predetermined gap.

The lateral periphery of the second screw member 32Y in the second transfer chamber serving as a developer transfer portion is also surrounded by the casing wall. On the two sides of the second screw member 32Y positioned on either side of the axial direction, the rear side plate 21Y-1 and front side plate 21Y-2 of the casing surround the second screw member 32Y from both sides of the axial direction. On one of the two sides of the second screw member 32Y positioned on either side of an orthogonal direction to the axial direction, a right side plate 21Y-4 of the casing, which serves as a side wall, extends in the rotary axis direction of the second screw member 32Y and faces the second screw member 32Y via a predetermined gap. On the other side, the partition wall 21Y-5 partitioning the first transfer chamber and second transfer chamber extends in the rotary axis direction of the second screw member 32Y and faces the second screw member 32Y via a predetermined gap.

The second screw member 32Y, the lateral periphery of which is surrounded by the wall, agitates the Y developer, not shown in the drawing, held in the screw vane 34Y in the rotary direction as it rotates, and at the same time transfers the Y developer from the left side to the right side in FIG. 12 in the rotary axis direction. The second screw member 32Y and developing sleeve 24Y are disposed parallel to each other, and therefore the transfer direction of the Y developer at this time also corresponds to the rotary axis direction of the developing sleeve 24Y. In this manner, the second screw member 32Y supplies the Y developer to the surface of the developing sleeve 24Y in the axial direction thereof.

Having been transferred to the vicinity of the right side end portion of the second screw member 32Y in the drawing, the Y developer passes through an opening provided in the partition wall 21Y-5 and enters the first transfer chamber, where it is held in the screw vane 28Y of the first screw member 26Y. The Y developer is then agitated in the rotary direction as the first screw member 26Y rotates, and at the same time is transferred from the right side to the left side in drawing in the rotary axis direction of the first screw member 26Y.

In the first transfer chamber, the Y toner concentration detection sensor 45Y is fixed to the lower wall of the casing in a part of a region surrounding the first screw member 26Y by the left side plate 21Y-3 of the casing and the partition wall 21Y-5. The Y toner concentration detection sensor 45Y detects the permeability of the Y developer transferred in the rotary axis direction by the first screw member 26Y from below, and outputs a voltage value corresponding to the detection result to the control portion 500. The permeability of the Y developer has a correlative relationship with the Y toner concentration of the Y developer, and therefore the control portion 500 learns the Y toner concentration on the basis of the output voltage value from the Y toner concentration detection sensor 45Y.

The printer portion 1 is provided with Y, C, M, K toner adding means, not shown in the drawing, for adding Y, C, M, K toner to the Y, C, M, K developing devices, respectively. The control portion 500 stores Y, C, M, K Vtref, which are target values of the output voltage values from the Y, C, M, K toner concentration detection sensors 45Y, C, M, K, in the RAM 502. When the difference between the output voltage value from the Y, C, M, K toner concentration detection sensor and the Y, C, M, K Vtref exceeds a predetermined value, the Y, C, M, K toner adding means are driven for a period corresponding to this difference. As a result, Y, C, M, K toner is added to the first transfer chamber through a toner adding port (A in FIG. 12, for example) provided on the furthest upstream side of the first transfer chamber in the Y, C, M, K developing devices, whereby the Y, C, M, K toner concentration of the Y, C, M, K developer is maintained within a constant range.

The permeability of the developer exhibits favorable correlation to the volume density of the developer. Even when the toner concentration of the developer is constant, the volume density of the developer varies in accordance with the storage conditions of the developer and so on. For example, when developer is left unstirred by the screw members in the first transfer chamber and second transfer chamber for a long time, air between the toner particles and the carrier is released due to the weight of the developer, and the charge of the toner particles decreases. Hence, as the period during which the developer is left increases, the volume density thereof gradually increases. As the volume density increases, the permeability gradually increases. When the developer is left for a certain long time period, increases in the volume density and permeability become saturated. In this saturated state, the distance between the magnetic carriers is smaller than that of active (agitated) developer, and therefore the toner concentration may be detected erroneously as being lower than the original value thereof.

Figure 13:
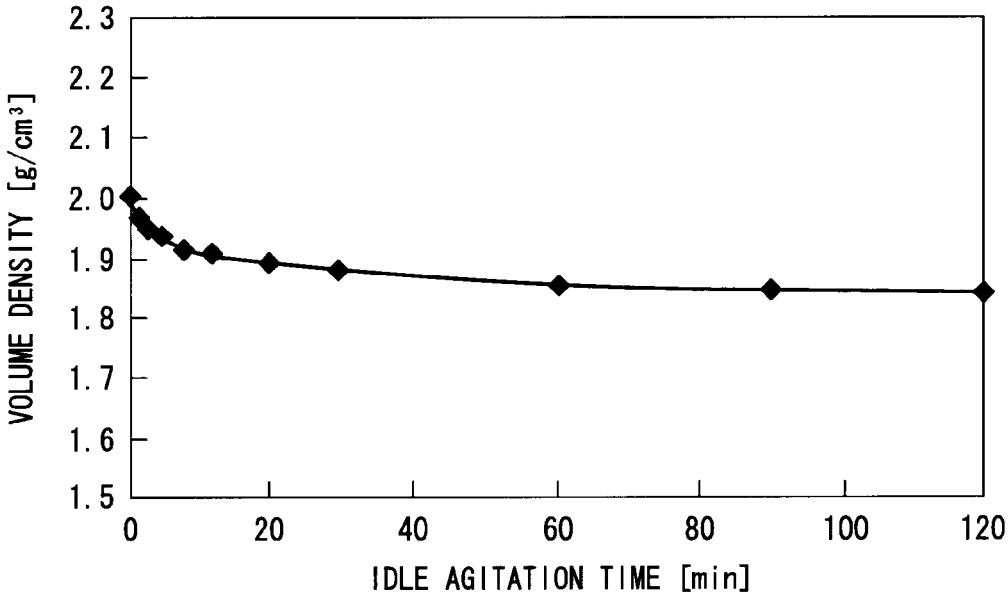
FIG. 13 is a graph showing the relationship between a volume density of a developer and an idle agitation time.
Figure 14:
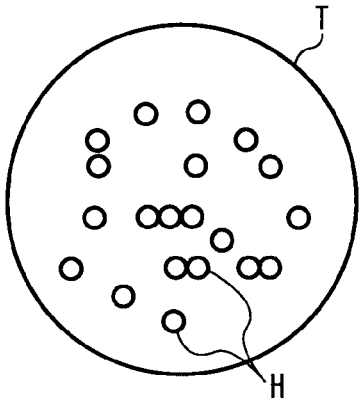
FIG. 14 is a pattern diagram showing toner particles in an initial state.
Figure 15:
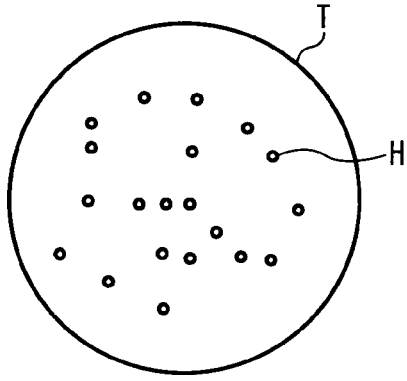
FIG. 15 is a pattern diagram showing the toner particles in the developer after idle agitation has been performed for 30 minutes.

On the other hand, when developer that has been left for a long time such that increases in the volume density and permeability thereof become saturated is agitated by the screw members in the first transfer chamber and second transfer chamber, air is taken in between the toner particles and magnetic carriers, and the frictional charge of the toner particles increases. Hence, when idle agitation, or in other words rotation of the screw members without performing development, is begun after the developer has been left in the first transfer chamber and second transfer chamber for a long time, the volume density falls rapidly for approximately three minutes from the start of idle agitation, as shown in FIG. 13. The reasons for this are that air is taken into the developer and the frictional charge of the toner increases rapidly. Thereafter, the volume density reduction rate decreases, but as the idle agitation time increases, the volume density continues to fall slowly. The reason for this is that the frictional charge of the toner particles increases little by little as an external additive added to the toner particles becomes worn. More specifically, as shown in FIG. 14, an external additive H for increasing the fluidity of toner particles T is added to the toner particles. As the external additive H gradually becomes worn due to idle agitation of the developer, the frictional force between the toner particles T gradually increases. After approximately three minutes of idle agitation, the increase in the frictional charge of the toner particles reaches near-saturation, but the frictional charge of the toner particles T continues to increase slowly as the frictional force between the toner particles T continues to rise gradually due to wear on the external additive H. Hence, even when three minutes or more have elapsed following the start of idle agitation, the volume density of the developer continues to decrease slowly over time. FIG. 14 shows the toner particles T in their initial state, and when thirty minutes have elapsed following the start of idle agitation, the toner particles T reach the state shown in FIG. 15. Note that the fluidity and volume density may be measured using the metallic powder apparent density testing method of JIS Z2504:2000.

Figure 16:
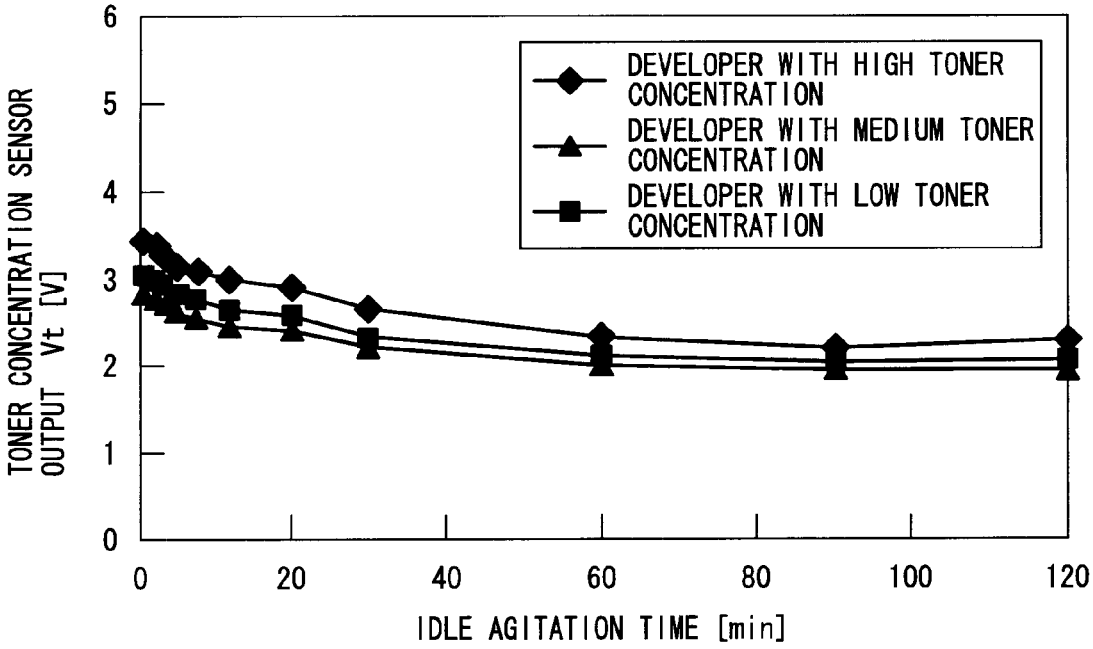
FIG. 16 is a graph showing the relationship between a toner concentration detection sensor output Vt and the idle agitation time.
Figure 17:
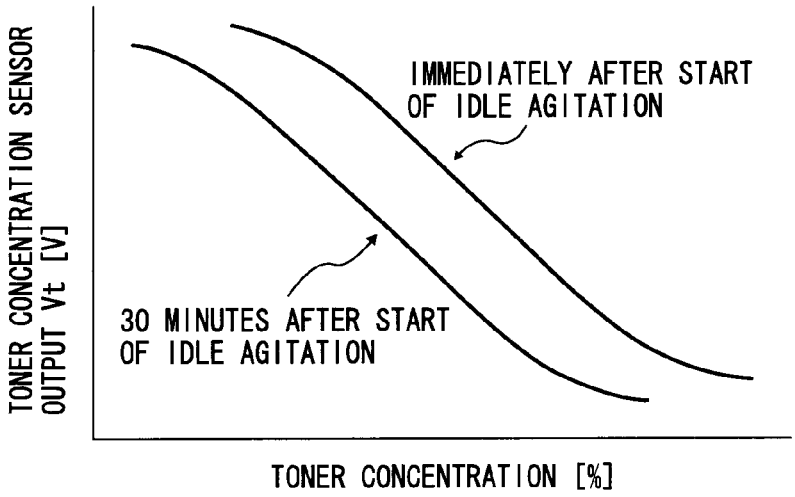
FIG. 17 is a graph showing the relationship between the toner concentration detection sensor output Vt and the toner concentration.

Thus, the volume density of the developer decreases slowly over a long period of time as idle agitation continues. Accordingly, as shown in FIG. 16, the permeability of the developer (the toner concentration detection sensor output Vt) decreases gradually, and the toner concentration detection result decreases gradually. When thirty minutes have elapsed following the start of idle agitation, a large difference occurs in the toner concentration detection sensor output Vt, even if the toner concentration of the developer is constant, as shown in FIG. 17. As a result, a toner concentration detection error occurs.

In the developing device described in Japanese Unexamined Patent Application Publication H6-308833, the pressure of the developer in a region where the toner concentration is detected by the toner concentration detection sensor is increased beyond the pressure of the developer in other regions of the developer transfer portion in order to suppress the occurrence of such detection errors. However, this pressure is the pressure of the developer in the transfer direction (the rotary axis direction of the screw member), and according to an experiment performed by the present inventors, a favorable correlation is not established between this pressure and the frequency with which detection errors occur.

Figure 18:
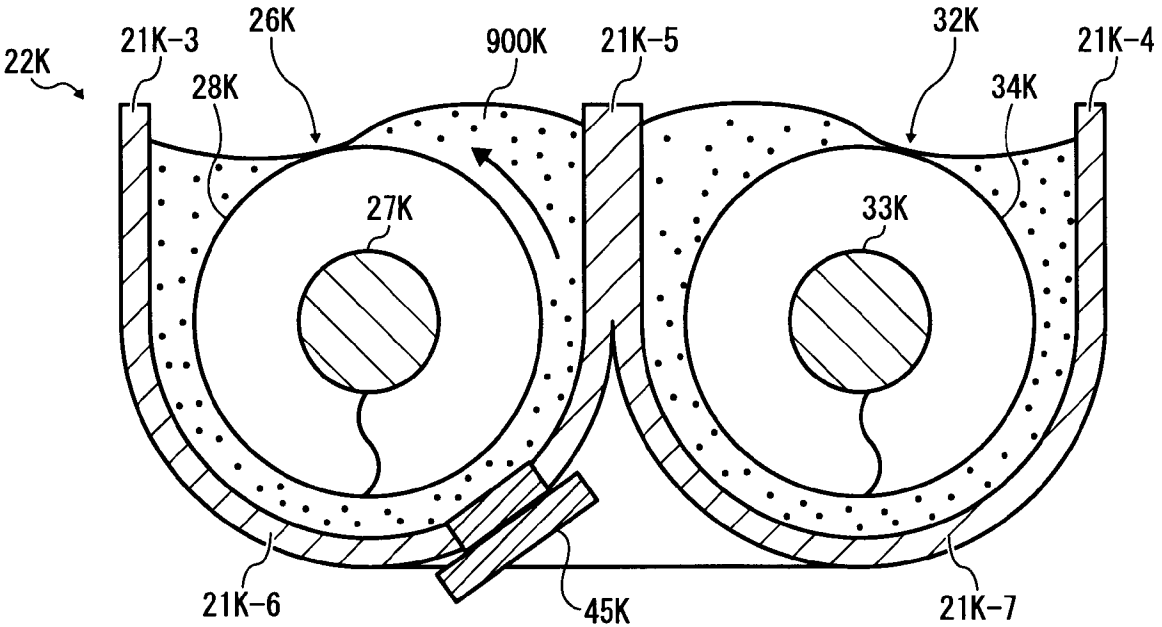
FIG. 18 is a view showing the constitution of a developer transferring device of a K developing device in the printer portion.

The reason for this is as follows. FIG. 18 is an enlarged constitutional diagram showing the developer transferring device 22K in the K developing device. In this drawing, the first transfer chamber enveloping the K first screw member 26K is disposed such that a bottom wall 21K-6 thereof faces a gravitational direction lower side of the first screw member 26K via a predetermined gap. Further, a left side plate 21K-3 faces one of the two lateral sides of the first screw member 26K, which are orthogonal to the rotary axis direction, via a predetermined gap, and a partition wall 21K-5 faces the other lateral side via a predetermined gap. K developer 900K is stored not only in the screw vane 28K of the first screw member 26K, but also in the clearance between the outer edge of the screw vane 28K and the left side plate 21K-3, the clearance between the outer edge of the screw vane 28K and the bottom wall 21K-6, and the clearance between the outer edge of the screw vane 28K and the partition wall 21K-5. The K toner concentration detection sensor 45K fixed to the casing of the developing device has a comparatively small detectable distance range, and cannot therefore detect the K toner concentration of the K developer in the screw vane 28K at a comparatively large distance therefrom. Hence, only the K toner concentration of the K developer 900K in the clearance between the outer edge of the screw vane 28K and the bottom wall 21K-6 can be detected by the sensor. Accordingly, the K developer 900K in the clearance must be pressurized sufficiently. However, the pressurizing force generated upon rotation of the first screw member 26K acts mainly on the K developer 900K stored in the screw vane 28K in the transfer direction (rotary axis direction) Therefore, even when the K developer 900K in the screw vane 28K is pressurized sufficiently in the transfer direction, the K developer 900K in the clearance is not pressurized sufficiently. For this reason, a favorable correlation is not established between the transfer direction pressure on the developer and the frequency with which toner concentration detection errors occur.

The present inventors also discovered the following problem with the constitution shown in the drawings. As the first screw member 26K rotates, the K developer 900K in the vicinity of the K toner concentration detection sensor 45K ceases to revolve actively unless the K developer 900K is pressed against the surface of the K toner concentration detection sensor 45K with sufficient pressure. If the same K developer 900K remains in the vicinity of the K toner concentration detection sensor 45K for a long time, regardless of the number of revolutions of the first screw member 26K, the K toner concentration thereof is detected continuously. As a result, it becomes impossible to detect substantial variation in the K toner concentration of the K developer 900K quickly.

Figure 19:
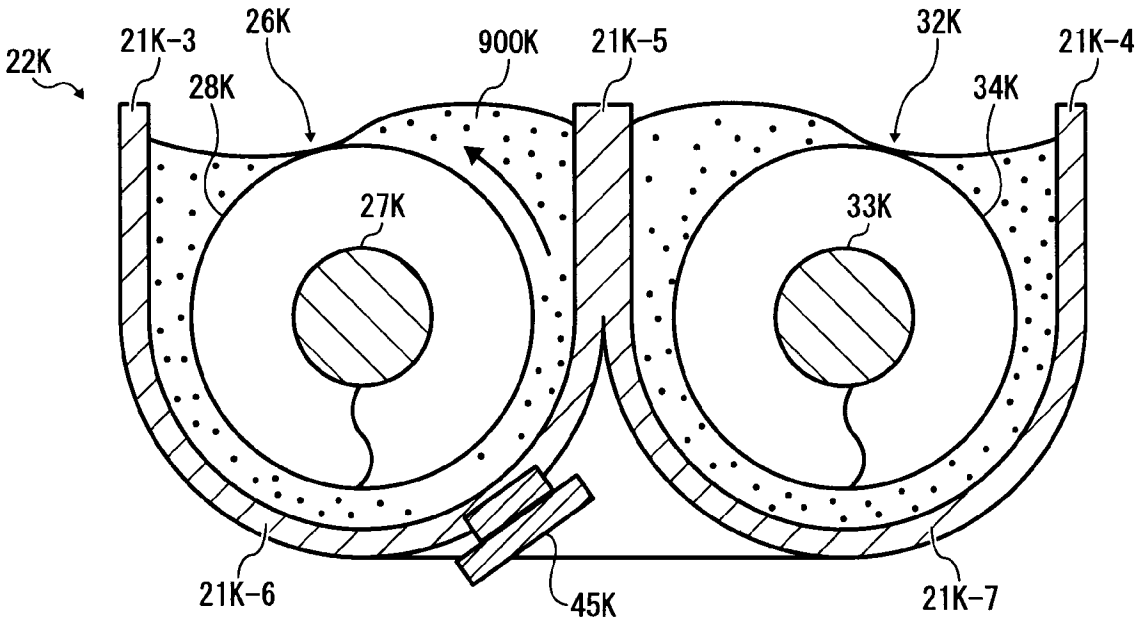
FIG. 19 is a constitutional diagram of the same developer transferring device constituted such that a wall is interposed between a K toner concentration detection sensor and K developer in a first transfer chamber.

Hence, instead of increasing the pressurizing force applied to the developer in the screw axis direction (transfer direction), the pressurizing force in the screw rotation direction must be increased so that the developer is pushed forcibly against the permeability detection surface of the toner concentration detection sensor. Note that in FIG. 18, the permeability detection surface of the K toner concentration detection sensor 45K contacts the K developer 900K in the first transfer chamber, but a constitution such as that shown in FIG. 19, in which a wall of the first transfer chamber (the bottom wall 21K-6 in the illustrated example) is interposed between the K developer 900K in the first transfer chamber and the K toner concentration detection sensor 45K, may be employed. In this case, the K developer 900K must be pushed forcibly against the wall interposed between the K developer 900K and the K toner concentration detection sensor 45K by the rotary force of the first screw member 26K.

Next, the features of the constitution of the copier according to the first embodiment will be described.

Figure 20:
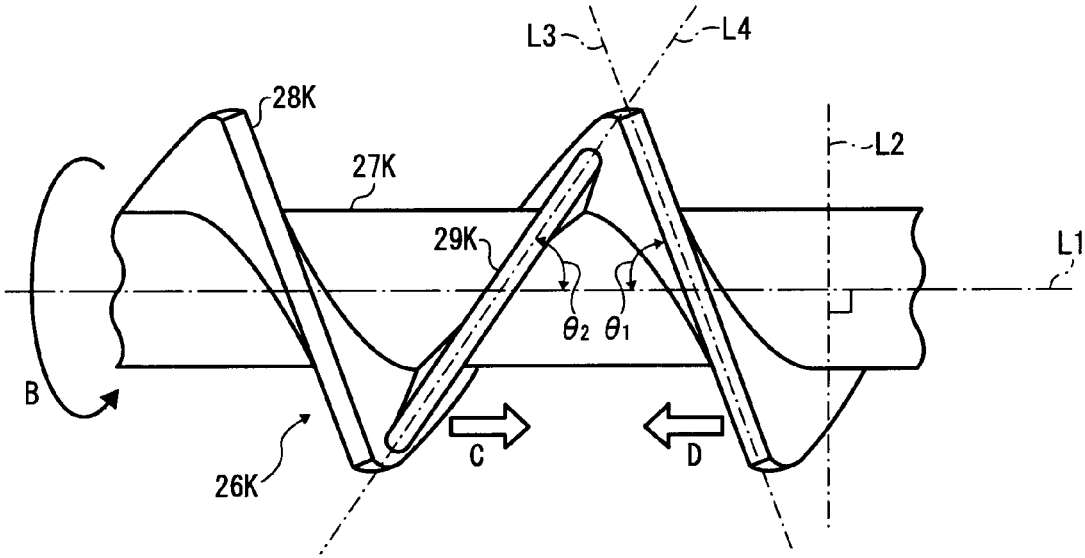
FIG. 20 is a partial side view showing a K first screw member in the copier.

FIG. 20 is an enlarged partial side view showing the K first screw member 26K of the copier. In the drawing, the rotary shaft member 27K is driven to rotate in the direction of an arrow B in the drawing. The screw vane 28K protruding from the peripheral surface of the rotary shaft member 27K protrudes from the rotary shaft member 27K at an incline having an angle θ1 relative to the rotary axis direction (the extension direction of a line segment L1) of the rotary shaft member 27K. Four angles may be formed by the line segment L1 and a line segment L3 serving as the extension direction of the screw vane 28K on the peripheral surface of the rotary shaft member 27K. These four angles form two pairs of opposite angles, i.e. identical angles. Hence, two angles are formed by the intersection between the line segment L1 and the line segment L3, and the angle θ1 is the smaller of these angles (this applies likewise to θ2 to be described below).

In the screw vane 28K of the first screw member 26K, a reverse transfer vane 29K protrudes form the peripheral surface of the rotary shaft member 27K between two opposing surfaces facing each other in the rotary axis direction (the extension direction of the line segment L1). The extension direction of the reverse transfer vane 29K on the peripheral surface of the rotary shaft member 27K (i.e. the extension direction of a line segment L4) is inclined relative to the extension direction of the line segment L1 in an opposite direction to the screw vane 28K, and an angle thereof is θ2.

The screw vane 28K rotates about the rotary shaft member 27K to transfer K developer, not shown in the drawing, in the direction of an arrow D in the drawing in the rotary axis direction. Conversely, the reverse transfer vane 29K rotates about the rotary shaft member 27K to transfer the K developer in the direction of an arrow C, i.e. the opposite direction to the transfer direction of the screw vane 28K. Of the entire rotary axis direction region of the first screw member 26K, the reverse transfer vane 29K protrudes from the rotary shaft member 27K in a region where the gravitational direction lower side faces the bottom wall (21K-6 in FIG. 19) of the first transfer chamber and the two lateral sides that are orthogonal to the rotary axis direction face the respective side walls (21K-3 and 21K-5 in FIG. 19) of the first transfer chamber. For convenience, the reverse transfer vane 29K has been omitted from FIGS. 18 and 19, but the K toner concentration detection sensor 45K is provided to detect the K toner concentration of the K developer transferred between the reverse transfer vane 29K and an adjacent location of the screw vane (a location extending along the line segment L3 in FIG. 20).

In the first screw member 26K shown in FIG. 12, the K toner concentration detection sensor (not shown) is disposed immediately below the formation region of the reverse transfer vane 29K.

With this constitution, the K developer that is transferred to the reverse transfer vane 29K and the K developer that is transferred to a location adjacent to the reverse vane collide with each other from opposite directions between the reverse transfer vane 29K and an adjacent location of the screw vane (reverse vane adjacent location). As a result, the K developer is pushed out in a normal line direction, whereby K developer positioned near the detection surface of the toner concentration detection sensor 45K is pushed forcibly toward the detection surface in the clearance between the outer edge of the first screw member 26K and the bottom wall (21K-6) of the first transfer chamber.

Figure 21:
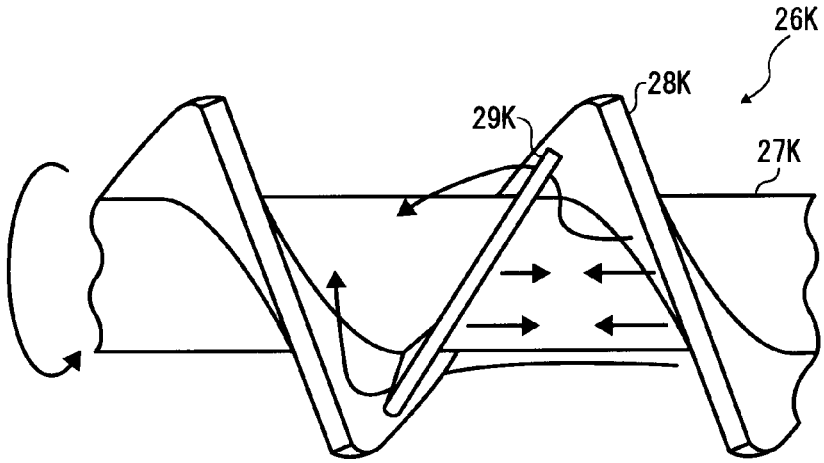
FIG. 21 is a side view illustrating the flow of the K developer in the first screw member.

In the screw vane 28K, the two opposing surfaces of the screw vane 28K facing each other on either side of the reverse transfer vane 29K are not connected to the reverse transfer vane 29K, and therefore gaps are formed between the reverse transfer vane 29K and the respective opposing surfaces. Hence, as shown in FIG. 21, apart of the K developer that collides due to reverse movement between the reverse transfer vane 29K and the reverse vane adjacent location of the screw vane 28K is transferred along the screw space through these gaps.

Figure 22:
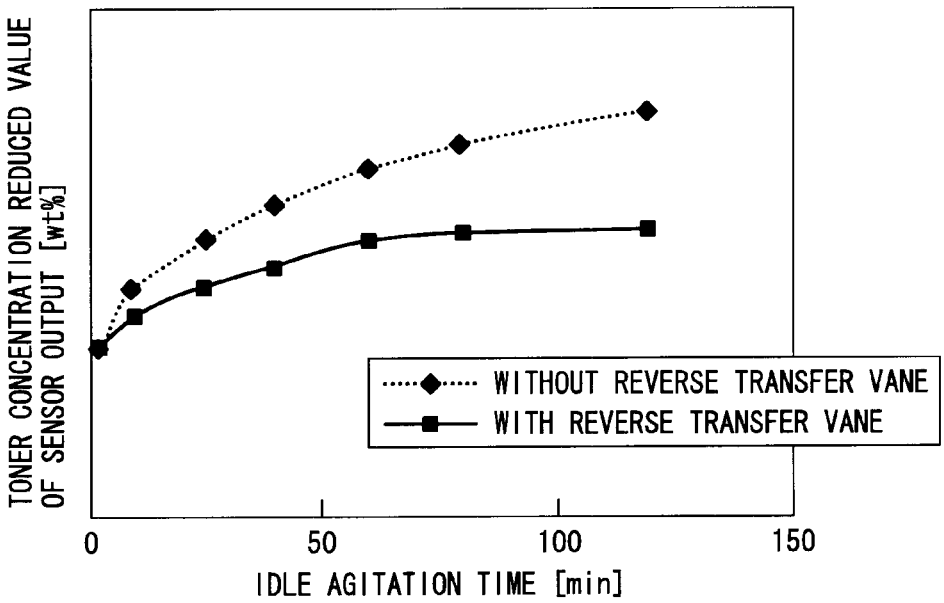
FIG. 22 is a graph showing the relationship between a toner concentration reduced value [wt %] of the toner concentration detection sensor output Vt [V] and the idle agitation time [min] when K developer having a K toner concentration of 8 [wt %] is agitated idly.
Figure 23:
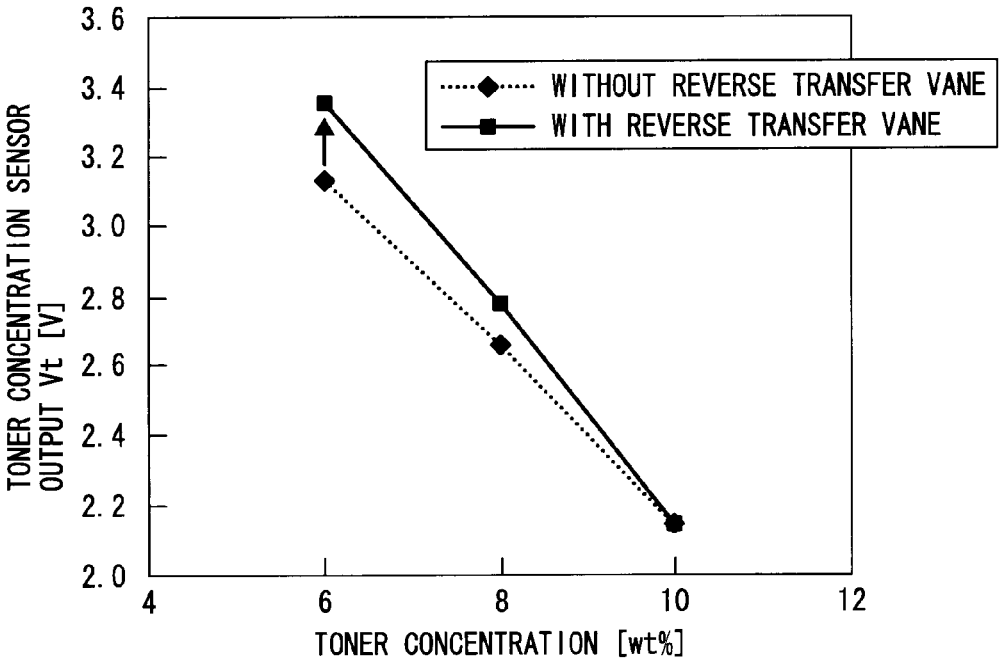
FIG. 23 is a graph showing the relationship between the toner concentration detection sensor output Vt [V] and the toner concentration [wt %]
Figure 25:
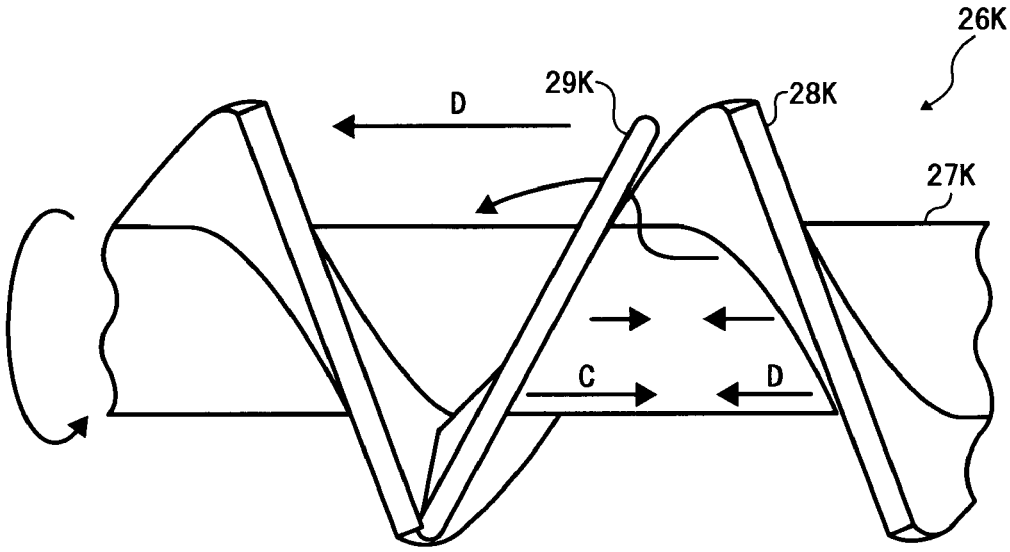
FIG. 25 is a partial side view showing the first screw member when only one end side of the reverse transfer vane is connected to a screw vane.

FIG. 22 is a graph showing the relationship between a toner concentration reduced value [wt %] of the toner concentration detection sensor output Vt [V] and the idle agitation time [min] when K developer having a K toner concentration of 8 [wt %] is agitated idly. As shown in the drawing, when a first screw member provided with the reverse transfer vane is used, a lower toner concentration can be detected than in a case where the first screw member is not provided with the reverse transfer vane. The reason for this is that when the first screw member is provided with the reverse transfer vane, the number of toner concentration detection errors is reduced. For reference, FIG. 23 shows the relationship between the toner concentration detection sensor output Vt [V] and the toner concentration [wt %]. Note that in an experiment performed to obtain the data shown in FIGS. 22 and 23, the first screw member shown in FIG. 25 provided with the reverse transfer vane, to be described below, was used. In this first screw member, the pitch of the screw vane in the screw rotary axis direction is 25 [mm], the incline angle θ2 of the reverse transfer vane from the axial direction is 45[°], and the protrusion height of the reverse transfer vane from the rotary shaft member surface is identical to that of the screw vane. A gap is provided between the reverse transfer vane disposed between the two surfaces of the screw vane and the surface of the screw vane on the downstream side in the developer transfer direction. Further, the toner concentration sensor has a detection surface diameter of 5 [mm], and is disposed such that the center of the detection surface opposes the intersection between the line segment L3 and the line segment L4 in FIG. 20.

Returning to FIG. 20, the developer transferring performance of the reverse transfer vane 29K for transferring the developer in the direction of the arrow C improves as the angle θ2 of the reverse transfer vane 29K relative to the line segment L2 approaches 45[°]. When the angle θ2 is set to be smaller than 45[°], the developer transferring performance in the direction of the arrow C deteriorates as the angle decreases, while the developer transferring performance in the rotary direction improves. When the angle θ2 is set at 0[°], the developer transferring performance in the rotary direction is maximized. This constitution is similar to the parallel fin employed in the developing device described in Japanese Unexamined Patent Application Publication H5-341649. According to an experiment performed by the present inventors, it was found that with a constitution in which the reverse transfer vane 29K is provided at a larger angle θ2 than 0[°], the number of toner concentration detection errors can be reduced (the developer can be pushed toward the detection surface of the toner concentration detection sensor more forcibly) in comparison with a constitution in which a parallel fin is provided. Furthermore, when the angle θ2 is set at 45[°], or in other words when the developer transferring performance in the direction of the arrow C is maximized, the number of toner concentration detection errors can be minimized.

Figure 24:
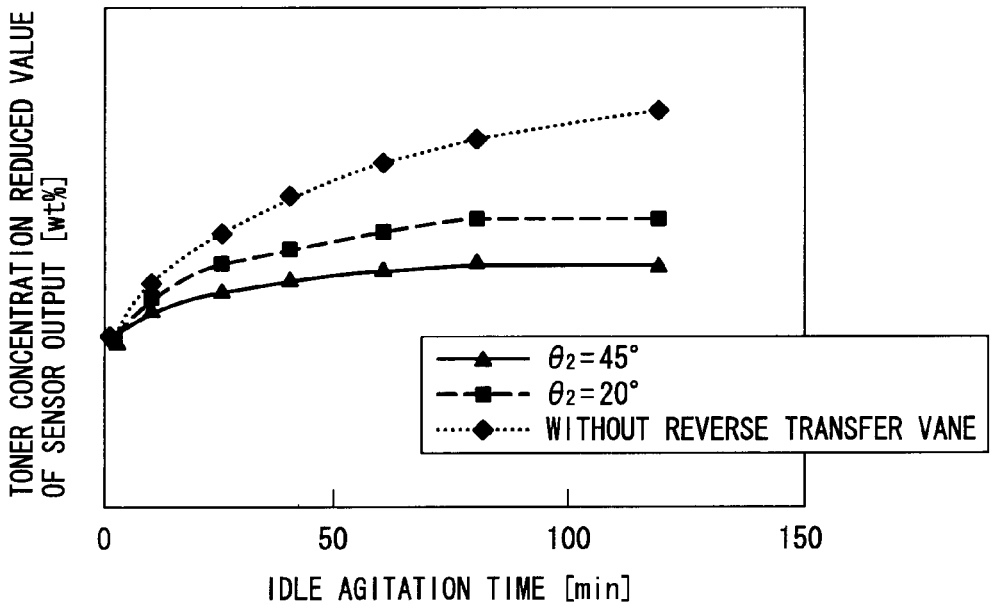
FIG. 24 is a graph showing the characteristics of the toner concentration reduced value of the sensor output in a case where a reverse transfer vane is not provided, a case where an angle θ2 of the reverse transfer vane is set at 45[°], and a case where the angle θ2 is set at approximately 20[°]

For reference purposes, FIG. 24 shows the characteristics of the toner concentration reduced value of the sensor output when the reverse transfer vane 29K is not provided, when the angle θ2 of the reverse transfer vane 29K is set at 45[°], and when the angle θ2 is set at 20[°]. The first screw member 26K shown in FIG. 27 was used to obtain the data shown in FIG. 24. In this first screw member 26K, the reverse transfer vane 29K, which is disposed between the two opposing surfaces of the screw vane 28K, is connected to each of these two surfaces, thereby bridging the screw vane. The results of an experiment performed using the first screw member 26K when the angle θ2 (see FIG. 20) between the extension direction of the reverse transfer vane 29K and the extension direction of the screw vane is set at 20[°] are shown on the line connected by square plot points in FIG. 24. Further, the results of an experiment performed using the first screw member 26K when the angle θ2 is set at 45[°] are shown on the line connected by triangular plot points in FIG. 24.

Figure 26:
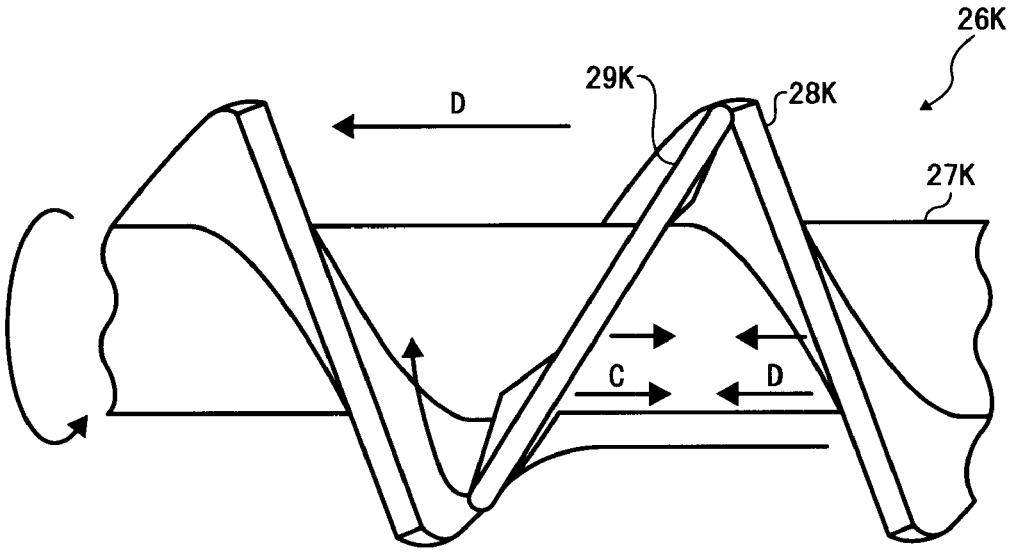
FIG. 26 is a partial side view of the first screw member when only the other end side of the reverse transfer vane is connected to the screw vane.
Figure 27:
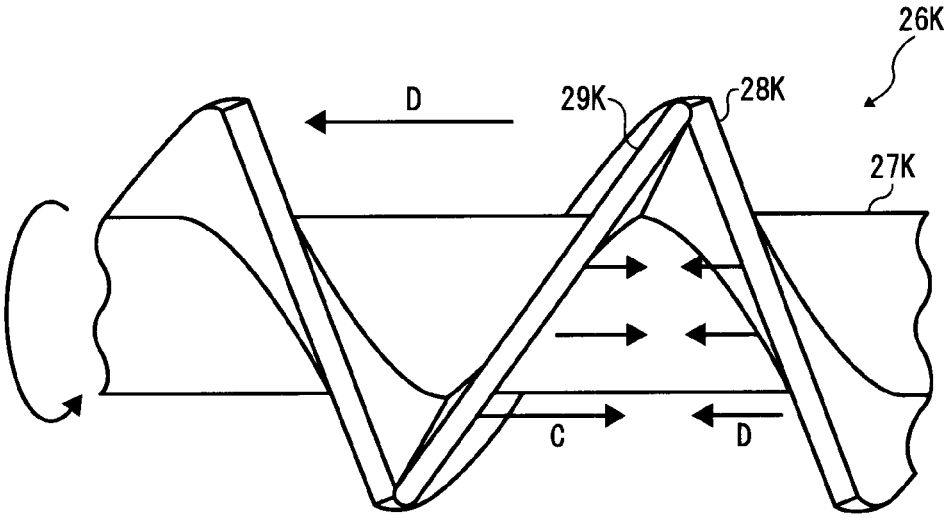
FIG. 27 is a partial side view of the first screw member when two opposing surfaces of the screw vane are bridged by the reverse transfer vane.
Figure 28:
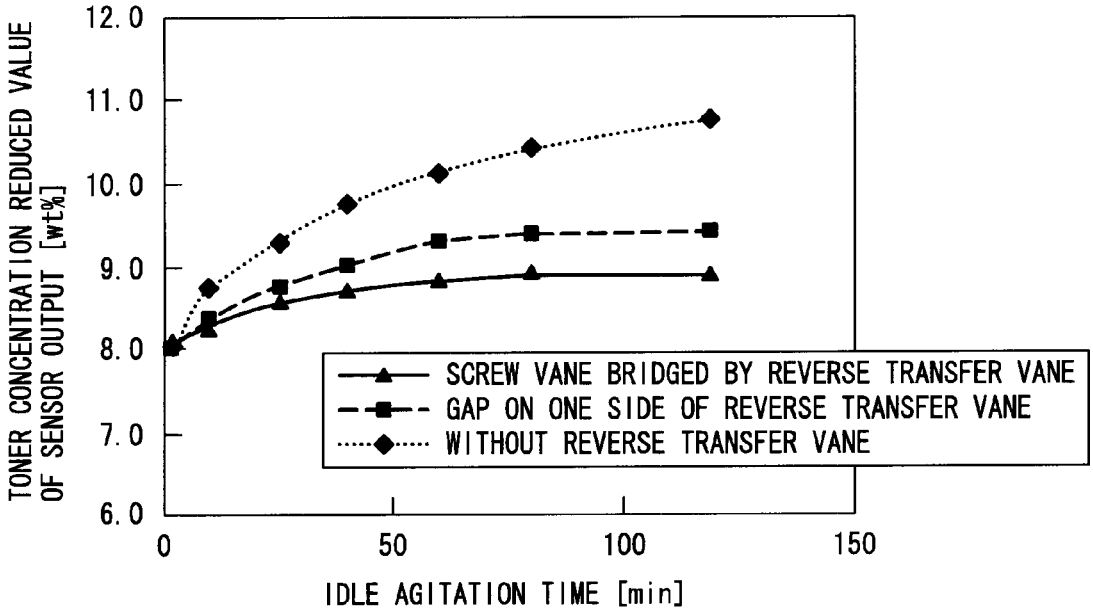
FIG. 28 is a graph showing the characteristics of the toner concentration reduced value of the sensor output in a case where the reverse transfer vane is not provided, a case where the two end sides of the reverse transfer vane bridge the screw vane, and a case where the two ends of the reverse screw vane are not connected to the screw vane.

In the first screw member 26K shown in FIG. 21, gaps are formed respectively between the reverse transfer vane 29K and the two opposing surfaces of the screw vane 28K. K developer, not shown in the drawing, held between these opposing surfaces moves smoothly along the screw space through these gaps. The gaps between the reverse transfer vane 29K and the two opposing surfaces do not necessarily have to be provided, but as shown in FIGS. 25 and 26, a gap is preferably provided between the reverse transfer vane 29K and at least one of the two opposing surfaces. The reason for this is that when the two opposing surfaces are bridged by the reverse transfer vane 29K, as shown in FIG. 27, transfer of the K developer in a normal direction (the direction of the arrow D in the drawing) along the rotary axis direction may be obstructed by the reverse transfer vane 29K. Note, however, that when the two opposing surfaces are bridged by the reverse transfer vane 29K, the pressing force applied to the K developer can be increased, as shown in FIG. 28, enabling a further reduction in the number of toner concentration detection errors. Hence, as long as the required K developer transfer speed in the normal direction can be secured, a first screw member 26K in which the opposing surfaces of the screw vane 28K are bridged by the reverse transfer vane 29K is preferably used as shown in FIG. 27.

Note that in the experiment performed to obtain the data in FIG. 28, the first screw member had the following characteristics both when the screw vane was bridged by the reverse transfer vane (the aspect shown in FIG. 27) and when a gap was provided on one side of the reverse transfer vane (the aspect shown in FIG. 25). The pitch of the screw vane in the screw rotary axis direction was 25 [mm], the incline angle θ2 of the screw vane from the axial direction was 45[°], and the protrusion height of the reverse transfer vane from the surface of the rotary shaft member was identical to that of the screw vane. Further, the toner concentration sensor had a detection surface diameter of 5 [mm].

As a result of the experiment, the present inventors discovered that when a gap is provided between the reverse transfer vane and the screw vane and the screw pitch is set at 25 [mm], a favorable result can be obtained by setting the gap between 0.5 and 10 [mm].

Figure 29:
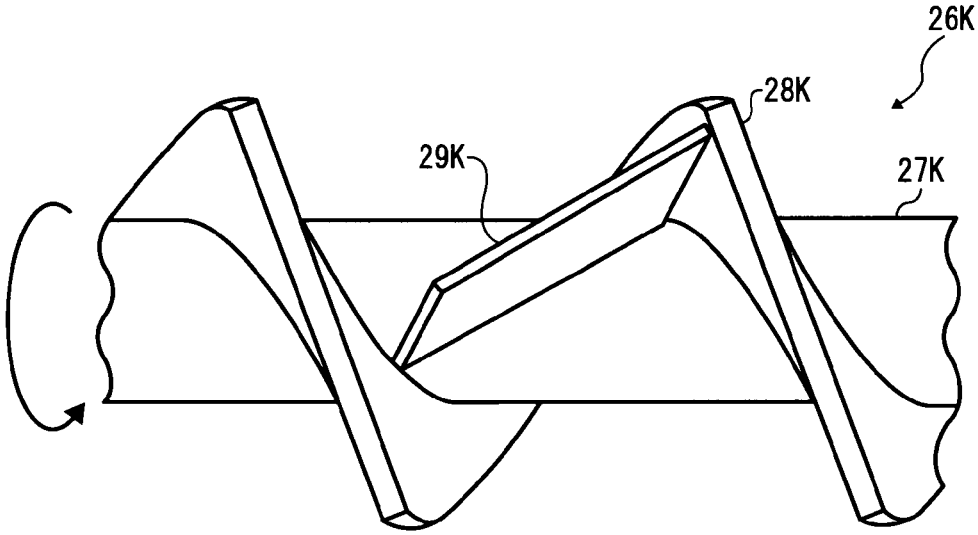
FIG. 29 is a side view showing a first screw member in which a component having a flat rectangular shape is provided as the reverse transfer vane.
Figure 30:
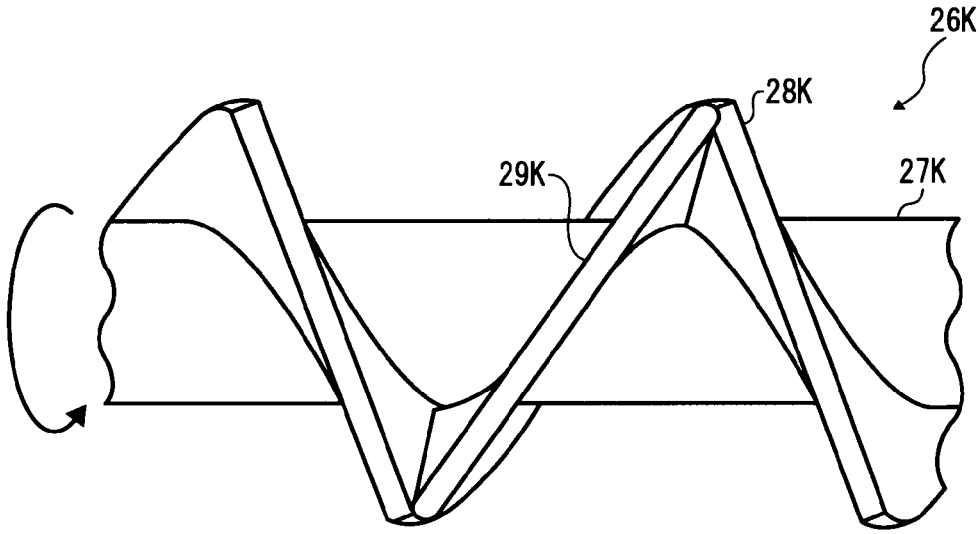
FIG. 30 is a side view showing a first screw member in which a component having a twisted shape is provided as the reverse transfer vane.
Figure 31:
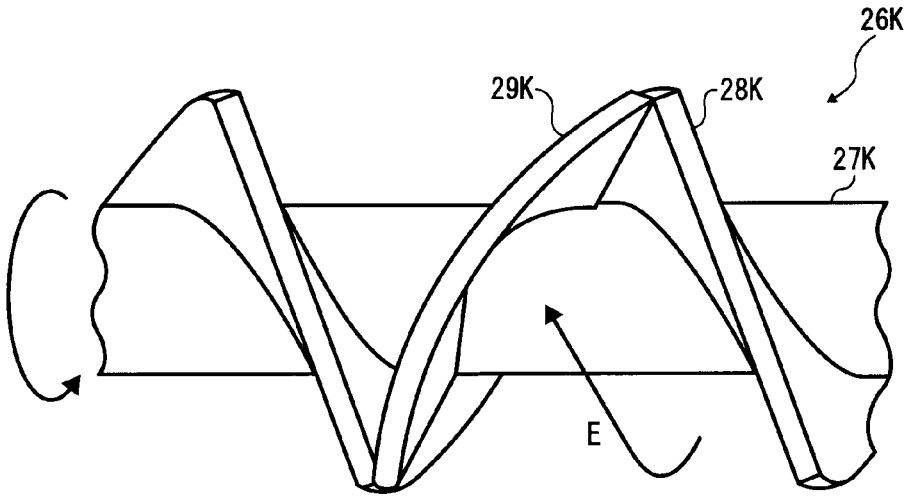
FIG. 31 is a side view showing a first screw member in which a component having an indentation is provided as the reverse transfer vane.

In addition to the shape shown in FIG. 21, the reverse transfer vane 29K may take a flat rectangular shape such as that shown in FIG. 29, a twisted shape such as that shown in FIG. 30, and a shape having an indentation facing the K developer movement direction (the direction of an arrow E in the drawing) within the screw space, such as that shown in FIG. 31, and so on. Further, as long as the K developer can be conveyed favorably, there are no limitations on the material thereof. For example, the reverse transfer vane may be a fin, a Mylar, a fin+Mylar constitution, and so on, which is integral with the rotary shaft portion or the screw vane. This applies likewise to the bridging vane of the second embodiment and the transfer vane of the third embodiment, to be described below.

Figure 32:
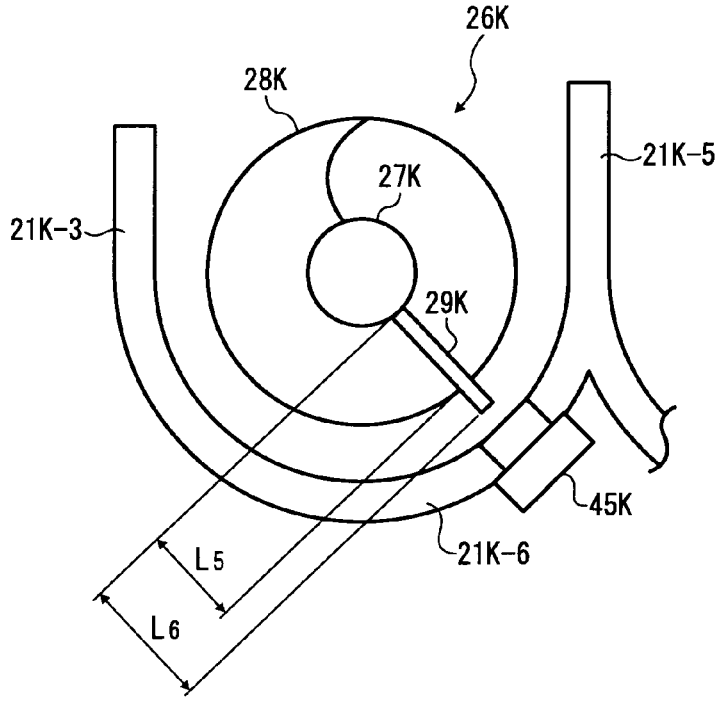
FIG. 32 is a lateral sectional view showing the first screw member cut along the reverse transfer vane part.

As shown in FIG. 32, a normal line direction protrusion amount L6 of the reverse transfer vane 29K from the peripheral surface of the rotary shaft member 27K is set to be larger than a normal line direction protrusion amount L5 of the screw vane 28K from the peripheral surface of the rotary shaft member 27K. With this constitution, the tip end of the reverse transfer vane 29K comes closer to the K toner concentration detection sensor 45K than the tip end of the screw vane 28K after moving to a position facing the sensor in accordance with the rotation of the first screw member 26K, and as a result, the K developer is pushed against the sensor more forcibly than when the protrusion amount L6 is equal to or smaller than the protrusion amount L5. Thus, the number of K toner concentration detection errors can be reduced.

Figure 33:
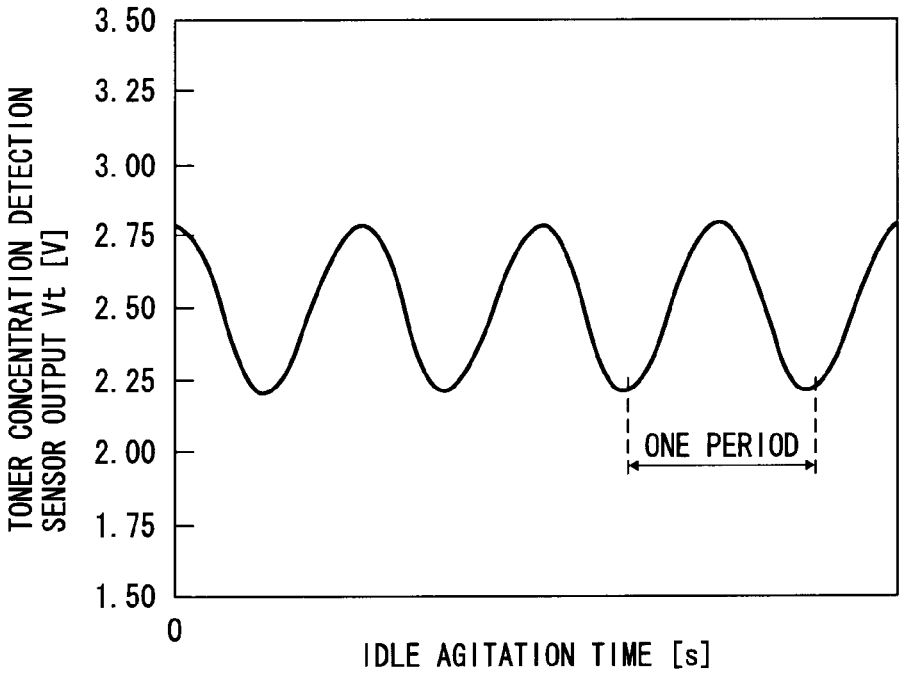
FIG. 33 is a graph showing the relationship between the toner concentration detection sensor output Vt [V] during idle agitation and the idle agitation time [s]

FIG. 33 is a graph showing the relationship between the toner concentration detection sensor output Vt [V] during idle agitation and the idle agitation time [s]. As shown in the drawing, the relationship between the toner concentration detection sensor output Vt and the idle agitation time takes a sine curve-shaped waveform. The reason for this is that the force by which the developer is pressed against the toner concentration detection sensor 45K is greatest when the reverse transfer vane 29K of the first screw member 26K passes the region facing the toner concentration detection sensor 45K as the first screw member 26K rotates. When a pressure sensor is attached to the K developer transferring device 22K in place of the K toner concentration detection sensor 45K, the relationship between the K toner concentration detection sensor output Vt and elapsed time also takes a sine curve-shaped waveform such as that shown in the drawing, and the period thereof is synchronous with the period of the waveform in FIG. 33. The toner concentration detection sensor output Vt reaches a maximum (a max point of the sine curve) when the reverse transfer vane 29K passes the position facing the K toner concentration detection sensor 45K as the first screw member 26K rotates, and as a result, the K toner concentration is detected accurately.

In a copier exhibiting these detection characteristics, when the toner concentration detection sensor output Vt at the lower limit point of the sine curve or the upper limit point of the sine curve is employed in toner concentration control, accurate toner concentration control becomes difficult due to variation in the number of detection errors. Hence, in this copier, the control portion 500 serving as control means is constituted to obtain the toner concentration detection sensor output Vt a plurality of times within a predetermined time period, extract from the plurality of obtained results only those that have a higher value than an average value of the plurality of detection results, and control driving of the aforesaid toner adding means on the basis of the extracted results. With this constitution, the toner concentration can be controlled more accurately than when the toner concentration detection sensor output Vt at the upper limit point or lower limit point is employed randomly.

Figure 34:
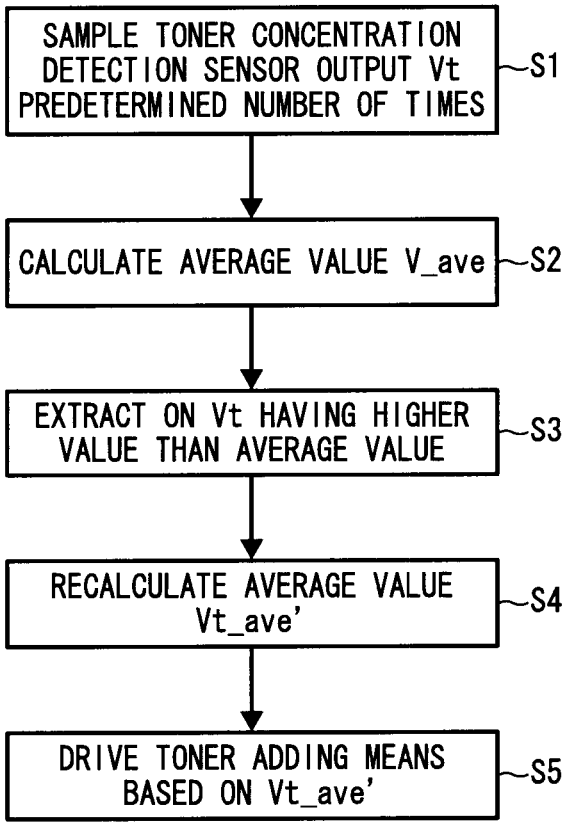
FIG. 34 is a flowchart showing the control flow of toner concentration control processing implemented by the control portion of the copier.

FIG. 34 is a flowchart showing the control flow of toner concentration control processing implemented by the control portion 500. In the drawing, the flow of toner concentration control processing for only one color is shown, but in actuality, identical toner concentration control processing is performed in parallel for each of the colors Y, C, M, K. In the drawing, first, at a predetermined timing, the toner concentration detection sensor output Vt is sampled a predetermined number of times at predetermined intervals (step 1; hereafter, step will be abbreviated to S). Next, an average value Vt_ave of the sampled data is calculated (S2), whereupon only toner concentration detection sensor outputs Vt having a higher value than the average value Vt_ave are extracted from the sampled plurality of toner concentration detection sensor outputs Vt (S3). The average value is then recalculated using only the extracted data (S4), whereupon toner is added by driving the toner adding means for a period of time corresponding to the recalculation result Vt_ave' (S5).

The K developer transferring device 22K was described above, but the developer transferring devices for the other colors are constituted similarly thereto.

Next, a color copier according to a second embodiment of the present invention will be described. Note that unless indicated otherwise, it is assumed that the constitution of the copier according to the second embodiment is identical to that of the first embodiment.

Figure 35:
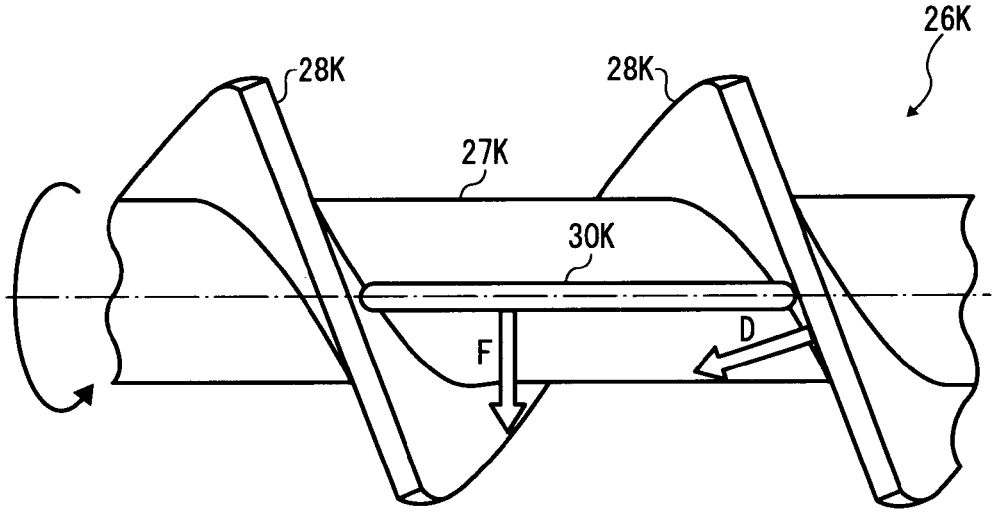
FIG. 35 is a partial side view of a K first screw member in a copier according to a second embodiment.

FIG. 35 shows a part of the K first screw member 26K in the copier according to the second embodiment. In this first screw member 26K, a bridging vane 30K protrudes from the peripheral surface of the rotary shaft member 27K between the two opposing surfaces of the screw vane 28K instead of the reverse transfer vane 29K of the first embodiment. The bridging vane 30K takes a flat rectangular shape extending in the rotary axis direction of the rotary shaft member 27K. The bridging vane 30K of this copier has a similar shape and attitude to the parallel fin of the developing device described in Japanese Unexamined Patent Application Publication H5-341649, but differs therefrom in that the two opposing surfaces of the screw vane 28K are bridged by the bridging vane 30K.

With the bridging vane 30K constituted in this manner, the K developer inside the screw space impinges on the bridging vane 30K as it moves, and as a result cannot escape from the screw space. The K developer then passes over the bridging vane 30K to escape into the clearance, and then re-enters the screw space. Hence, in comparison with the developing device described in Japanese Unexamined Patent Application Publication H5-341649, in which, having impinged on the parallel fin, the developer can escape in the axial direction without entering the clearance, movement of the developer in the rotation radius direction is vigorous in the position facing the toner concentration detection sensor, and hence the developer is pushed against the toner concentration detection sensor more forcibly. As a result, the number of toner concentration detection errors caused by variation in the volume of the toner can be reduced below that of the developing device described in Japanese Unexamined Patent Application Publication H5-341649.

Similarly to the reverse transfer vane of the first embodiment, the normal line direction protrusion amount of the bridging vane 30K from the peripheral surface of the rotary shaft member 27K is set to be larger than the normal line direction protrusion amount of the screw vane 28K from the peripheral surface of the rotary shaft member 27K.

Next, a copier according to a third embodiment of the present invention will be described. Note that unless indicated otherwise, it is assumed that the constitution of the copier according to the third embodiment is identical to that of the first embodiment.

Figure 36:
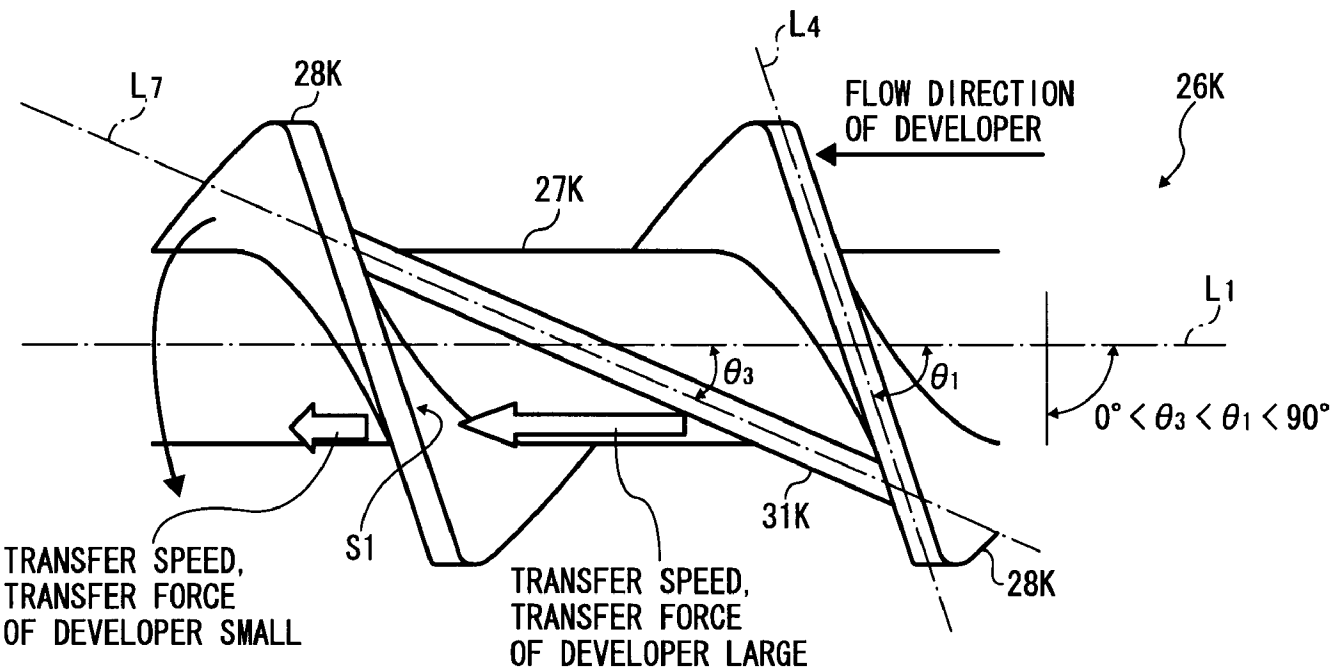
FIG. 36 is a partial side view of a K first screw member in a copier according to a third embodiment.

FIG. 36 is an enlarged side view showing a part of the K first screw member 26K in the copier according to the third embodiment. In this first screw member 26K, a transfer vane 31K protrudes from the peripheral surface of the rotary shaft member 27K between the two opposing surfaces of the screw vane 28K instead of the reverse transfer vane 29K of the first embodiment. The transfer vane 31K bridges the screw vane 28K, and an incline angle θ3 thereof is smaller than the incline angle θ1 of the screw vane 28K ($0° < \theta 3 < \theta 1 < 90°$). The transfer vane 31K provided with this incline angle θ3 transfers the developer in a relatively identical direction to the screw vane 28K but at a higher speed than the screw vane 28K.

Between the transfer vane 31K and the screw vane 28K, the transfer vane 31K having the higher developer transfer speed pushes the developer onto the surface (the surface indicated by the reference symbol S1 in the drawing) of the screw vane 28K having the lower developer transfer speed. A part of the developer pushed in this manner moves along the surface of the screw vane 28K in the normal line direction of the first screw member 26K. The developer then moves to the outside of the first screw member 26K and is pushed forcibly against the detection surface of the toner concentration detection sensor, not shown in the drawing. Thus, in comparison with a screw member provided with a parallel fin, developer in the vicinity of the detection surface of the toner concentration sensor is pushed toward the detection surface more forcibly. Furthermore, by pushing the developer forcibly against the detection surface and causing the developer to withdraw from the detection surface as the transfer vane 31K rotates, the developer in the vicinity of the detection surface can be actively replaced. As a result, the number of toner concentration detection errors caused by variation in the toner volume can be reduced in comparison with the related art.

Note that four angles may be formed by the line segment L1 extending in the rotary axis direction of the first screw member 26K and a line segment L7 serving as the extension direction of the transfer vane 31K on the peripheral surface of the rotary shaft member 27K, and these four angles form two pairs of opposite angles, i.e. identical angles. Hence, two angles are formed by the intersection between the line segment L1 and the line segment L7, and an angle θ3 is the smaller of these angles.

Figure 37:
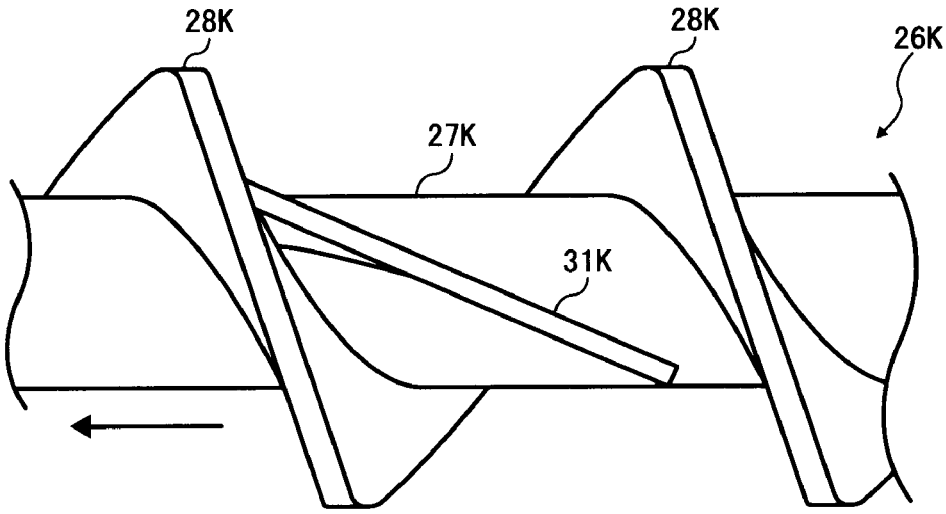
FIG. 37 is a side view showing a first modification of the first screw member.
Figure 38:
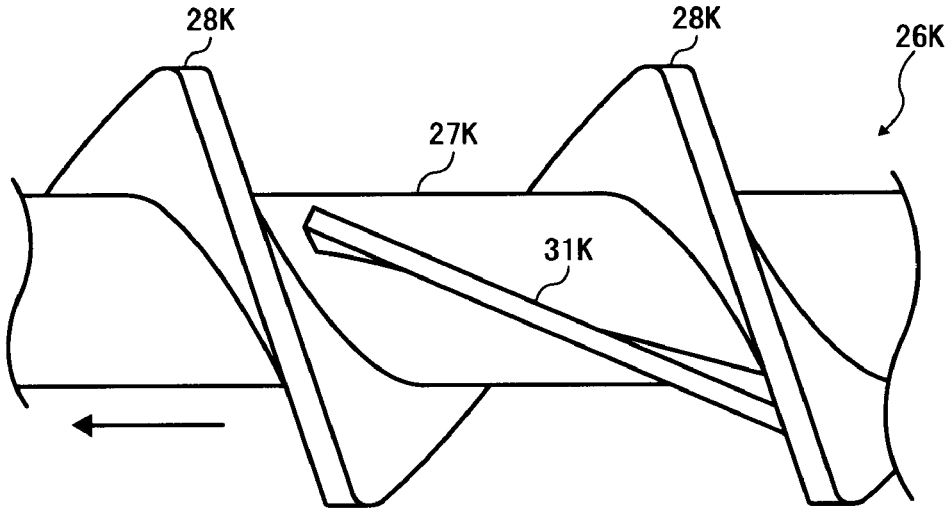
FIG. 38 is a side view showing a second modification of the first screw member.
Figure 39:
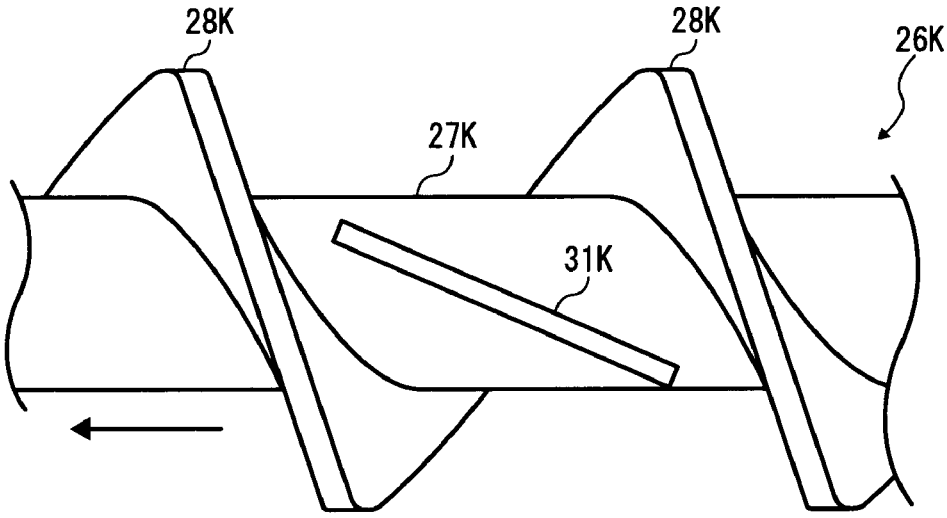
FIG. 39 is a side view showing a third modification of the first screw member.

Further, the transfer vane 31K shown in the drawing also functions as a bridging vane for bridging the screw vane 28K, but a gap may be provided between the screw vane 28K and transfer vane 31K. As shown in FIG. 37, for example, a gap may be provided between the screw vane 28K and an end portion on the downstream side of the developer transfer direction (the direction indicated by the arrow in the drawing) in the lengthwise direction of the transfer vane 31K. Alternatively, as shown in FIG. 38, a gap may be provided between the screw vane 28K and an end portion on the upstream side of the developer transfer direction (the direction indicated by the arrow in the drawing) in the lengthwise direction of the transfer vane 31K. Further, as shown in FIG. 39, gaps may be provided between the screw vane 28K and both end portions of the developer transfer direction in the lengthwise direction of the transfer vane 31K.

In the copier according to the first embodiment described above, the reverse transfer vane 29K is disposed between the two opposing surfaces of the screw vane 28K that face each other in the rotary axis direction, and a gap is provided between the reverse transfer vane 29K and at least one of the two opposing surfaces. With this constitution, as described above, the developer can be transferred more favorably in the rotary axis direction than when a gap is not provided.

Further, in the copiers according to the first embodiment and second embodiment, the normal line direction protrusion amount of the reverse transfer vane 29K or bridging vane 30K from the rotary shaft member 27K is set to be larger than the normal line direction protrusion amount of the screw vane 28K from the rotary shaft member 27K. With this constitution, as described above, the number of toner concentration detection errors can be reduced below a case in which the former protrusion amount is equal to or smaller than the latter protrusion amount.

Further, in the copiers according to the first embodiment and second embodiment, the control portion 500 serving as control means is constituted to obtain a plurality of detection results from the toner concentration detection sensor serving as toner concentration detecting means, extract from the plurality of obtained results only those that have a higher value than an average value of the plurality of obtained results, and control driving of the toner adding means on the basis of the extracted results. With this constitution, as described above, the toner concentration can be controlled more accurately than when random detection results are employed as is.

The following results are obtained in the present invention.

(1) The reverse transfer vane of the screw member and a location of the screw vane adjacent to the reverse transfer vane (to be referred to hereafter as the reverse vane adjacent location) transfer the developer in opposite directions to each other in the rotary axis direction. As a result, the developer collides from opposite directions between the reverse transfer vane and the reverse vane adjacent location and is pushed outward in the normal line direction. Developer positioned near the detection surface of the toner concentration detecting means within the clearance between the outer edge of the screw vane and the wall of the developer transfer portion is pushed forcibly toward the detection surface by the developer that is pushed out from the screw vane in the normal line direction. In the developing device of Japanese Unexamined Patent Application Publication H5-341649, the developer in the clearance is pushed toward the detection surface by the aforesaid parallel fin, but a volume-reducing compression force is not applied to the developer. In the present invention, on the other hand, the developer is transferred and caused to collide from opposite directions by the reverse transfer vane and the screw vane adjacent location, and therefore the developer in the clearance is pushed forcibly toward the detection surface of the toner concentration detecting means while being compressed in the rotary axis direction. As a result, the developer near the detection surface of the toner concentration detecting means is pushed toward the detection surface more forcibly than in the case of a screw member provided with a parallel fin. Furthermore, by pushing the developer forcibly against the detection surface and causing the developer to withdraw from the detection surface as the reverse transfer vane rotates, the developer in the vicinity of the detection surface can be actively replaced. As a result, the number of toner concentration detection errors caused by variation in the toner volume can be reduced in comparison with the related art.

(2) Between the transfer vane and the screw vane, the transfer vane having the higher developer transfer speed pushes the developer onto the surface of the screw vane having the lower developer transfer speed. A part of the developer pushed in this manner moves along the surface of the screw vane in the normal line direction of the first screw member so as to be pushed forcibly against the detection surface of the toner concentration detection sensor. Thus, in comparison with a screw member provided with a parallel fin, developer in the vicinity of the detection surface of the toner concentration detecting means is pushed toward the detection surface more forcibly. Furthermore, by pushing the developer forcibly against the detection surface and causing the developer to withdraw from the detection surface as the transfer vane rotates, the developer in the vicinity of the detection surface can be actively replaced. As a result, the number of toner concentration detection errors caused by variation in the toner volume can be reduced in comparison with the related art.

(3) When the developer held in the screw space of the screw member moves along the screw space, the developer impinges on the bridging vane bridging the two opposing surfaces of the screw vane. The developer that impinges on the bridging vane is pushed by developer to the rear thereof so as to pass over the bridging vane while being pushed. At this time, the developer near the detection surface of the toner concentration detecting means within the clearance between the outer edge of the screw member and the wall of the developer transfer portion is pushed toward the detection surface while being compressed in the transfer direction by the movement of the developer that passes over the bridging vane. Likewise with this constitution, in comparison with a screw member provided with a parallel fin, developer in the vicinity of the detection surface of the toner concentration detecting means is pushed toward the detection surface more forcibly. Furthermore, by pushing the developer forcibly against the detection surface and causing the developer to withdraw from the detection surface as the transfer vane rotates, the developer in the vicinity of the detection surface can be actively replaced. As a result, the number of toner concentration detection errors caused by variation in the toner volume can be reduced in comparison with the related art.

Various modifications will become possible for those skilled in the art after receiving the teachings of the present disclosure, without departing from the scope thereof.

What is claimed is:

1. A developer transferring device comprising:

a rotatably supported rotary shaft member;

a developer transferring portion for transferring a developer containing a toner and a carrier in a rotary axis direction while agitating said developer as a screw member having a screw vane that protrudes in spiral form from a peripheral surface of said rotary shaft member rotates; and toner concentration detecting means for detecting a toner concentration of said developer transferred within said developer transferring portion, wherein, of an entire rotary axis direction region of said screw member, a reverse transfer vane for transferring said developer in an opposite direction to said screw vane as said rotary shaft member rotates protrudes from said rotary shaft member in a region where a gravitational direction lower side faces a bottom wall of said developer transferring portion and two lateral sides that are orthogonal to the rotary axis direction face respective side walls of said developer transferring portion, and said toner concentration detecting means are disposed to detect said toner concentration of said developer as said developer is transferred between said reverse transfer vane and a location of said screw vane adjacent to said reverse transfer vane.

2. The developer transferring device according to claim 1, wherein said reverse transfer vane is disposed between two opposing surfaces of said screw vane that oppose each other in said rotary axis direction, and a gap is provided between said reverse transfer vane and at least one of said two opposing surfaces.

3. The developer transferring device according to claim 1, wherein a normal line direction protrusion amount of said reverse transfer vane from said rotary shaft member is set to be larger than a normal line direction protrusion amount of said screw vane from said rotary shaft member.

4. A developer transferring device comprising:

a rotatably supported rotary shaft member;

a developer transferring portion for transferring a developer containing a toner and a carrier in a rotary axis direction while agitating said developer as a screw member having a screw vane that protrudes in spiral form from a peripheral surface of said rotary shaft member rotates; and toner concentration detecting means for detecting a toner concentration of said developer transferred within said developer transferring portion, wherein a transfer vane for transferring said developer in a relatively identical direction to said screw vane but at a higher speed than said screw vane as said rotary shaft member rotates protrudes from a location of said rotary shaft member between two opposing surfaces of said screw vane that oppose each other in said rotary axis direction.

5. The developer transferring device according to claim 4, wherein a gap is provided between said transfer vane and at least one of said two opposing surfaces.

6. The developer transferring device according to claim 4, wherein a normal line direction protrusion amount of said transfer vane from said rotary shaft member is set to be larger than a normal line direction protrusion amount of said screw vane from said rotary shaft member.

7. A developer transferring device comprising:

a rotatably supported rotary shaft member;

a developer transferring portion for transferring a developer containing a toner and a carrier in a rotary axis direction while agitating said developer as a screw member having a screw vane that protrudes in spiral form from a peripheral surface of said rotary shaft member rotates; and toner concentration detecting means for detecting a toner concentration of said developer transferred within said developer transferring portion, wherein a bridging vane for bridging two opposing surfaces of said screw vane that oppose each other in said rotary axis direction protrudes from said rotary shaft member, and said toner concentration detecting means are disposed to detect said toner concentration of at least said developer that is agitated by said bridging vane, wherein a normal line direction protrusion amount of said bridging vane from said rotary shaft member is set to be larger than a normal line direction protrusion amount of said screw vane from said rotary shaft member, and wherein the normal line direction protrusion amount of said bridging vane being larger than a normal line direction protrusion amount of said screw vane is provided at a portion of said bridging vane corresponding to a position of said toner concentration detecting means, such that a tip end of said bridging vane comes closer to said toner concentration detecting means than a tip end of the screw vane.

8. A developing device comprising:

a developer transferring device for transferring a developer containing a toner and a carrier; and a developer carrier for developing a latent image carried on an image carrier by carrying said developer transferred by said developer transferring device on a surface thereof that performs an endless motion so as to transfer said developer to a region facing said image carrier in accordance with said endless motion thereof, wherein said developer transferring device comprises:

a rotatably supported rotary shaft member;

a developer transferring portion for transferring said developer containing said toner and said carrier in a rotary axis direction while agitating said developer as a screw member having a screw vane that protrudes in spiral form from a peripheral surface of said rotary shaft member rotates; and toner concentration detecting means for detecting a toner concentration of said developer transferred within said developer transferring portion, a reverse transfer vane for transferring said developer in an opposite direction to said screw vane as said rotary shaft member rotates protrudes from said rotary shaft member in a region of an entire rotary axis direction region of said screw member where a gravitational direction lower side faces a bottom wall of said developer transferring portion and two lateral sides that are orthogonal to the rotary axis direction face respective side walls of said developer transferring portion, and said toner concentration detecting means are disposed to detect said toner concentration of said developer as said developer is transferred between said reverse transfer vane and a location of said screw vane adjacent to said reverse transfer vane.

9. A process unit in which at least an image carrier for carrying a latent image and developing means for developing said latent image on said image carrier in an image forming apparatus comprising said image carrier, said developing means, and transferring means for transferring a visible image developed on said image carrier onto a transfer body are held in a common holder as a single unit and inserted into and detached from a main body of said image forming apparatus integrally, wherein said developing means comprise:

a developer transferring device for transferring a developer containing a toner and a carrier; and a developer carrier for developing said latent image carried on said image carrier by carrying said developer transferred by said developer transferring device on a surface thereof that performs an endless motion so as to transfer said developer to a region facing said image carrier in accordance with said endless motion thereof, said developer transferring device comprises:

a rotatably supported rotary shaft member;

a developer transferring portion for transferring said developer containing said toner and said carrier in a rotary axis direction while agitating said developer as a screw member having a screw vane that protrudes in spiral form from a peripheral surface of said rotary shaft member rotates; and toner concentration detecting means for detecting a toner concentration of said developer transferred within said developer transferring portion, a reverse transfer vane for transferring said developer in an opposite direction to said screw vane as said rotary shaft member rotates protrudes from said rotary shaft member in a region of an entire rotary axis direction region of said screw member where a gravitational direction lower side faces a bottom wall of said developer transferring portion and two lateral sides that are orthogonal to the rotary axis direction face respective side walls of said developer transferring portion, and said toner concentration detecting means are disposed to detect said toner concentration of said developer as said developer is transferred between said reverse transfer vane and a location of said screw vane adjacent to said reverse transfer vane.

10. An image forming apparatus comprising:

an image carrier for carrying a latent image; and developing means for developing said latent image on said image carrier, wherein said developing means comprise:

a developer transferring device for transferring a developer containing a toner and a carrier; and a developer carrier for developing said latent image carried on said image carrier by carrying said developer transferred by said developer transferring device on a surface thereof that performs an endless motion so as to transfer said developer to a region facing said image carrier in accordance with said endless motion thereof, said developer transferring device comprises:

a rotatably supported rotary shaft member;

a developer transferring portion for transferring said developer containing said toner and said carrier in a rotary axis direction while agitating said developer as a screw member having a screw vane that protrudes in spiral form from a peripheral surface of said rotary shaft member rotates; and toner concentration detecting means for detecting a toner concentration of said developer transferred within said developer transferring portion, a reverse transfer vane for transferring said developer in an opposite direction to said screw vane as said rotary shaft member rotates protrudes from said rotary shaft member in a region of an entire rotary axis direction region of said screw member where a gravitational direction lower side faces a bottom wall of said developer transferring portion and two lateral sides that are orthogonal to the rotary axis direction face respective side walls of said developer transferring portion, and said toner concentration detecting means are disposed to detect said toner concentration of said developer as said developer is transferred between said reverse transfer vane and a location of said screw vane adjacent to said reverse transfer vane.

11. The image forming apparatus according to claim 10, further comprising:

toner adding means for adding toner to said developing means; and controlling means for obtaining a plurality of detection results from said toner concentration detecting means, extract from said plurality of obtained results only those that have a higher value than an average value of said plurality of detection results, and controlling driving of said toner adding means on the basis of said extracted results.

* * * * *